US011286673B2

(12) United States Patent
Zveibil

(10) Patent No.: US 11,286,673 B2
(45) Date of Patent: Mar. 29, 2022

(54) ROTATABLE AND COMPACTABLE COVER

(71) Applicant: EMANUEL ZULAR ZVEIBIL, Sao Paulo SP (BR)

(72) Inventor: Emanuel Zular Zveibil, Sao Paulo SP (BR)

(73) Assignee: Emanuel Zular Zveibil, Sao Paulo SP (BR)

( * ) Notice: Subject to any disclaimer, the term of this patent is extended or adjusted under 35 U.S.C. 154(b) by 0 days.

(21) Appl. No.: 17/260,546

(22) PCT Filed: Oct. 17, 2019

(86) PCT No.: PCT/BR2019/050450

§ 371 (c)(1),
(2) Date: Jan. 14, 2021

(87) PCT Pub. No.: WO2020/107084

PCT Pub. Date: Jun. 4, 2020

(65) Prior Publication Data

US 2021/0277660 A1 Sep. 9, 2021

(30) Foreign Application Priority Data

Nov. 27, 2018 (BR) ..... 10 2018 074479 8

(51) Int. Cl.
*E04F 10/10* (2006.01)
*E04F 10/00* (2006.01)

(52) U.S. Cl.
CPC ..... *E04F 10/10* (2013.01); *E04F 10/005* (2013.01)

(58) Field of Classification Search
CPC ..... E04F 10/10; E04F 10/08; E04F 10/005
See application file for complete search history.

(56) References Cited

U.S. PATENT DOCUMENTS 415,102 A * 11/1889 Fullerton ..... E04F 10/0618 160/70
1,150,764 A 8/1915 Hocking
(Continued)

FOREIGN PATENT DOCUMENTS

BE 1006486 A3 9/1994
BR 8301948 A 11/1984
(Continued)

*Primary Examiner* — Beth A Stephan
(74) *Attorney, Agent, or Firm* — The Watson IP Group, PLC; Jovan N. Jovanovic

(57) ABSTRACT

The rotatable and compactable cover (1) proposed herein comprises two movable elements (4) mounted directly against the wall (P) or to a column or post (C/P); on the movable elements (4), movable side rails (23) are mounted, which are mutually parallel; pivoting support elements (30) are mounted on the movable side rails (23) against which the continuous cover plates (29) are attached; the rotatable and compactable cover (1) has actuators (49) comprised of arms with tension springs; the rotatable and compactable cover (1) also has a locking device (2) and a retraction device (3) that are mounted on the same plane as the wall (P); the rotatable and compactable cover (1) has a set of actuators (49) comprised of arms with tension springs; the upper region of the rotatable and compactable cover (1) incorporates a pair of blades (66), said blades (66) being mounted on supports (67) fixed directly to the wall (P) and covering the upper end of the continuous cover plates (29).

10 Claims, 38 Drawing Sheets

(56) References Cited

U.S. PATENT DOCUMENTS

| | | | | |
|---|---|---|---|---|
| 2,107,676 | A | 2/1938 | Neumann | |
| 6,095,221 | A * | 8/2000 | Frey, Jr. | E04F 10/0614 135/88.12 |
| 2010/0252208 | A1* | 10/2010 | Svirsky | E04F 10/10 160/61 |
| 2017/0336104 | A1* | 11/2017 | Tenghoff | F24S 40/85 |

FOREIGN PATENT DOCUMENTS

| | | | |
|---|---|---|---|
| CA | 2311339 | A1 | 1/2001 |
| ES | 1078998 | U | 4/2013 |
| GB | 730078 | A | 5/1955 |
| NL | 7703999 | A | 10/1978 |
| WO | 2013093451 | A2 | 6/2013 |

* cited by examiner

DETAIL: A

DETAIL: B

DETAIL: C

DETAIL: D

DETAIL: E

DETAIL: A1

DETAIL: B1

DETAIL: C1

DETAIL: D1

DETAIL: A2

DETAIL: B2

DETAIL: C2

DETAIL: D2

DETAIL: W

DETAIL: Z

DETAIL: Z'

DETAIL: G

DETAIL: H

DETAIL: I

DETAIL: J

DETAIL: K

DETAIL: L

DETAIL - M

DETAIL - N

DETAIL - O

DETAIL - P

DETAIL - Q

DETAIL - R

DETAIL - S

DETAIL - T

DETAIL - U

DETAIL - V

ROTATABLE AND COMPACTABLE COVER

FIELD OF APPLICATION

This Invention Patent application refers to a rotatable and compactable cover that can be installed and used as a means of protection against bad weather, which can present the most diverse uses. The cover presented herein is part of the field of cover structures, which includes, for example, articulated and retractable coverings and the like.

Preamble

This Invention Patent application describes a rotatable and compactable cover formed by a structure that can be mounted against a wall or other suitable architectural element, said structure featuring movable supporting elements for continuous cover plates, allowing the set of continuous cover plates to assume both a non-folded and compacted condition in which the area to be covered is protected from the weather, as well as a folded and compacted condition, where the set of continuous cover plates assumes a position in which the area to be covered is fully exposed, and the movement of the movable supporting elements of the continuous cover plates are moved between these two positions by direct manual operation, as well as by manually operated mechanisms or motorized means.

STATE OF THE ART

The state of the art relating to the object of this Invention Patent application can be defined by the existence of a number of documents addressing objects belonging to the same field of application.

One of the documents that can be considered pertinent to the analysis of the object treated herein is Brazilian Publication No. PI 7901419-4, filed on Mar. 7, 1979 and named "PAINEL DE CHAPAS CONTÍNUAS PARALELAS E OSCILANTES [PANEL OF CONTINUOUS PARALLEL AND OSCILLATING PLATES]", wherein it is informed that said panel is intended for the composition of ceilings, walls, windows and other cover or division plans.

In said panel, continuous parallel and oscillating plates are mounted on bars or support side rails, and between the plate panel and the support side rails are the articulation device and the oscillatory control of the plates.

According to the design of said panel, the moment of oscillation of the plates occurs between two extreme points, one of these points corresponding to the total closure, a condition that coincides with the superposition of the plates by their longitudinal edges, while the other extreme corresponds to the total opening, which coincides with the plates spaced by their turning centers.

Another document that also integrates the state of the art pertinent to the object treated herein is represented by Brazilian Publication No. PI9302611-0, filed on Aug. 2, 1993 and named "PAINEL DE CHAPAS CONTÍNUAS PARALELAS E COMPACTÁVEIS [PANEL OF PARALLEL AND COMPATIBLE CONTINUOUS PLATES]", which was a development of the object treated in document Brazilian Publication No. PI 7901419-4.

Said panel of parallel and compactable continuous plates presents great structural similarity with the panel of continuous parallel and oscillating panels, including, however, pantograph that runs along the side rails and on which the parallel and compactable continuous plates are mounted, in such a way that when the pantograph is activated in the direction of its retraction, the parallel and compactable continuous plates execute a movement that progressively changes its angulation in the same proportion as the entire package of plates is being compacted on one side of the panel, thus opening, integrally, a substantial area of the panel itself.

Another document belonging to the state of the art is Brazilian Publication No. PI 9005655-8, filed on Nov. 1, 1990 and named "COBERTURA SOLAR TRANSLADÁVEL [TRAVERSABLE SOLAR COVER]", said cover being formed by two parallel lines aligned with cover plates, each mounted on a structural frame consisting of a set of support beams arranged in parallel and spaced apart.

An orthogonal pin is centrally incorporated under each support beam, in which a tubular sleeve is inserted in the upper end of a traverse arm. The plates of each row can be moved in coplanar traverse motion so as to fully cover the area to be protected or to expose such area.

Problems of the State of the Art

Although each of the objects treated in the documents cited represented an advance before the proposed solutions, in none of the examples described can the covering surfaces be effectively compacted, and in their movement, to pass from a condition of total coverage to total exposure, it is required a considerable area around the area to be covered, such as that verified in relation to the object treated in document Brazilian Publication No. PI 9005655-8, while in relation to documents Brazilian Publication No. PI 7901419-4 "PAINEL DE CHAPAS CONTÍNUAS PARALELAS E OSCILANTES" and Brazilian Publication No. PI9302611-0, filed on Aug. 2, 1993 and named "PAINEL DE CHAPAS CONTÍNUAS PARALELAS E COMPACTÁVEIS", although the covering area does not have to be expanded, on the other hand, its total exposure also does not occur.

Object of the Invention

In view of the designs treated in the documents pertaining to the state of the art aforementioned, it is one of the objects of this Invention Patent application to provide a rotatable and compactable cover, which features a design that allows it to cover a certain area when fully extended and to be folded and compacted to one side when fully collected, thus determining the total exposure of the area previously covered.

It is also another object of this Invention Patent application to provide a rotatable and compactable cover that can be activated either through direct manual operation, as well as through manually operated mechanisms or even through motorized means.

Finally, it is further an object of this Invention Patent application to provide a rotatable and compactable cover that can be dimensioned to present the most varied areas, which can also be mounted next to a suitable wall or architectural element and which can still be used in an isolated way (a single rotatable and compactable cover), or in a pair with the sets of continuous plates of each cover unit presenting a slope such that it can lead the rainwater to the side gutters, as well as to a single central gutter between the cover units.

BRIEF DESCRIPTION OF THE INVENTION

The rotatable and compactable cover object of this Invention Patent application is essentially formed by a structure having two movable supporting elements made based on metallic profiles and with a triangular shape, and said movable supporting elements support the set of continuous cover plates. Between the movable supporting elements and the continuous cover plates are also provided movable side rails, the side rails are mutually parallel.

The continuous cover plates are mounted next to the side rails using pivoting support elements positioned along the continuous cover plates in the cross sections with the side rails. Each pivoting support element is basically formed by two components, the first being the support rod, while the second component is a laminar piece with a shape compatible with the cross section of the continuous cover plates.

The support rod has a vertical rod section inferiorly provided with a threaded end that receives a washer and a corresponding clamping nut, said vertical section at its upper end has a welded washer that acts as a limiting element for insertion into the profile of the side rail.

The vertical rod section of the pivoting support element continues in an angled rod section that receives the laminar piece assembly. The angled rod section is provided with through holes where it is fixed by means of rivets to the already aforementioned laminar piece, against which the continuous cover plate is effectively mounted.

DESCRIPTION OF THE DRAWINGS

The object of this Invention Patent application will be described in detail according to the figures listed below, in which.

DETAILED DESCRIPTION OF THE INVENTION

Figure 1:
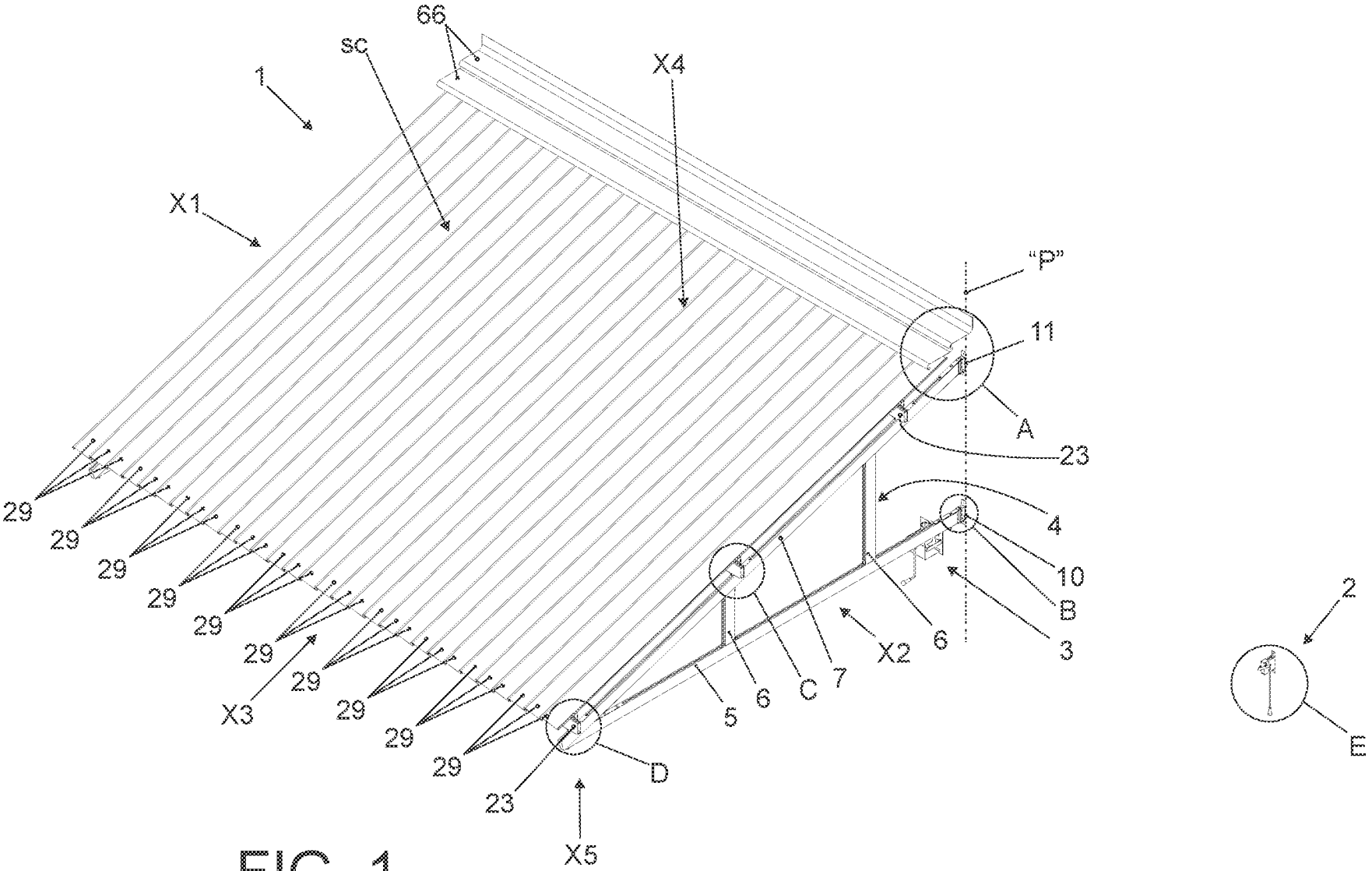
FIG. 1 shows a general, top, and front view of the rotatable and compactable cover being fully extended.
Figure 2:
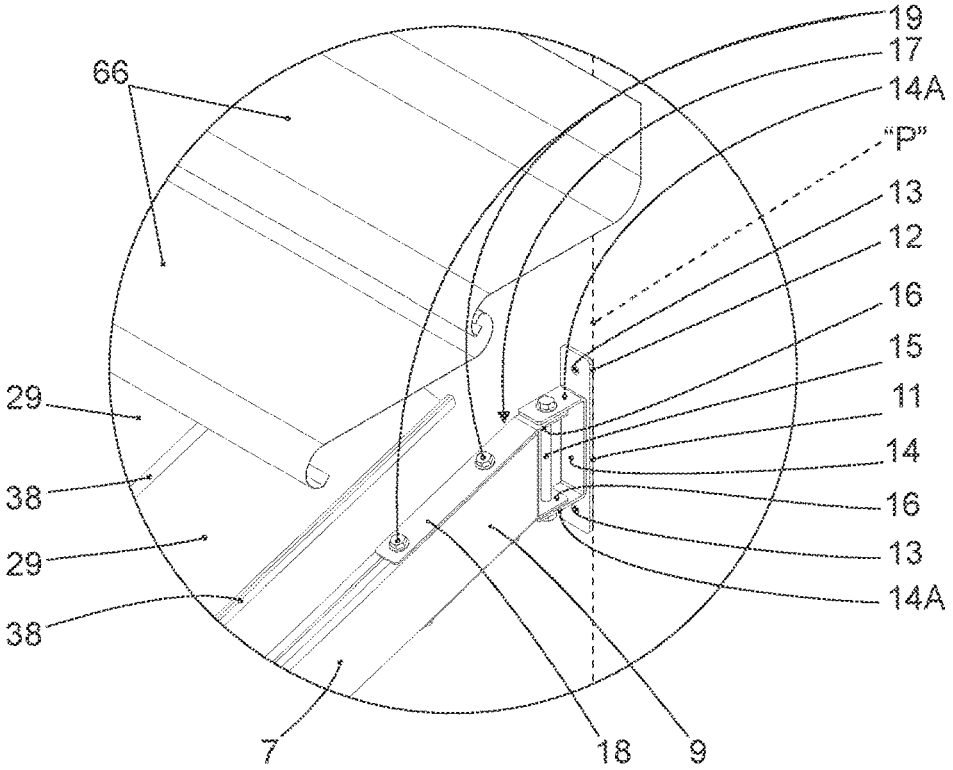
FIG. 2 shows an enlarged detail of the rotatable and compactable cover indicated as "A" in FIG. 1.
Figure 3:
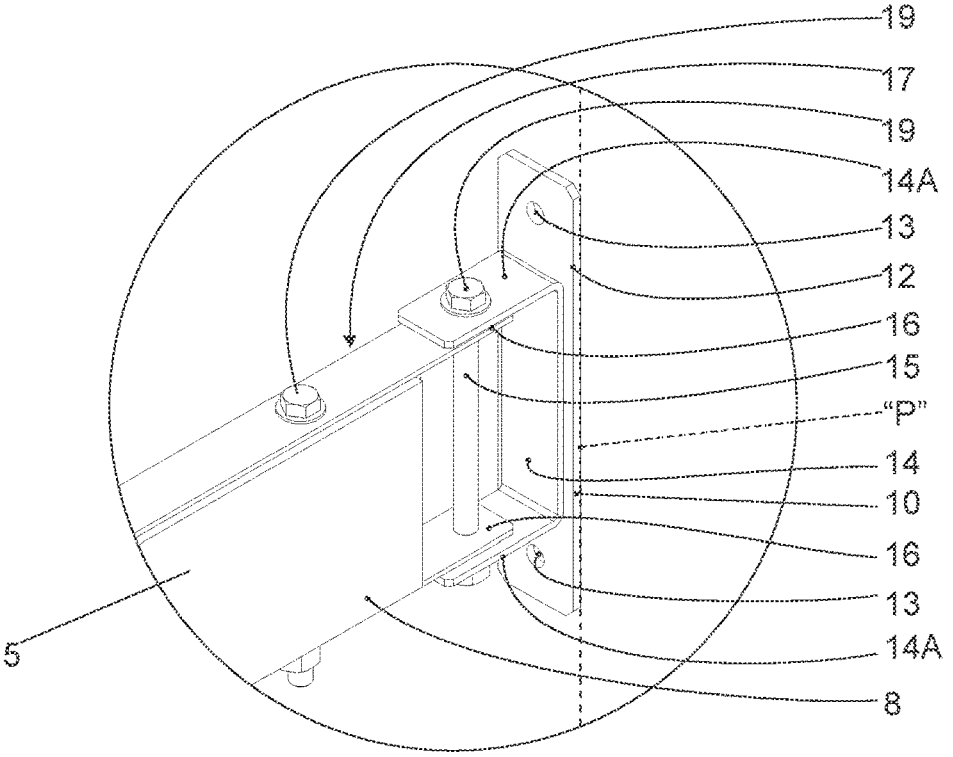
FIG. 3 shows an enlarged detail of the rotatable and compactable cover indicated as "B" in FIG. 1.
Figure 4:
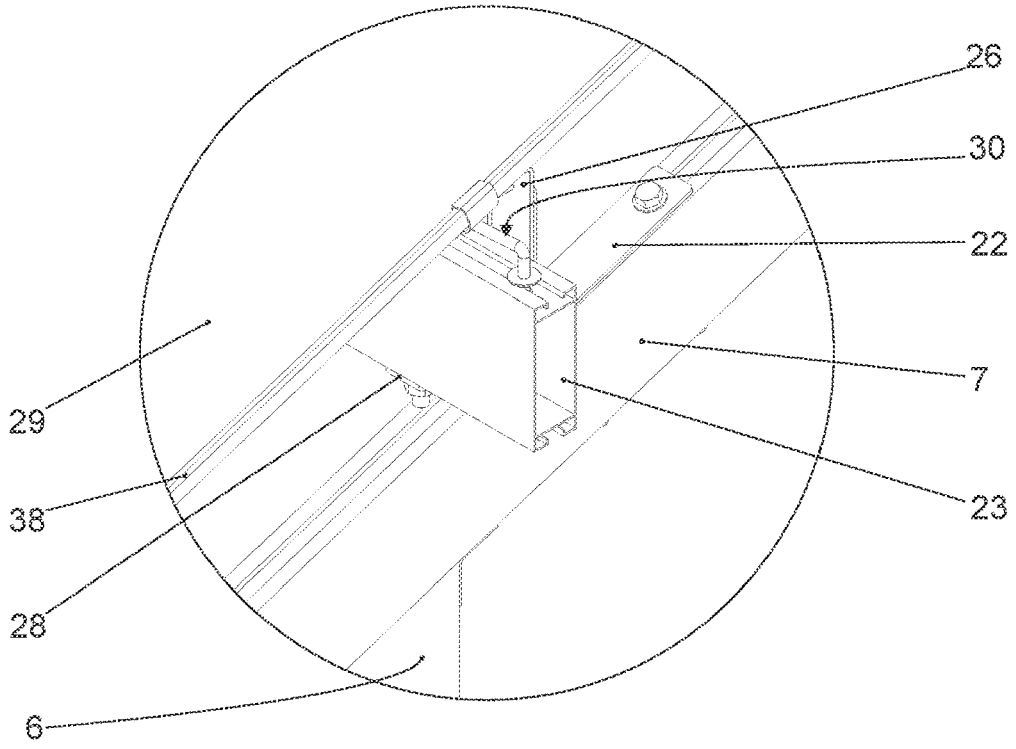
FIG. 4 shows an enlarged detail of the rotatable and compactable cover indicated as "C" in FIG. 1.
Figure 5:
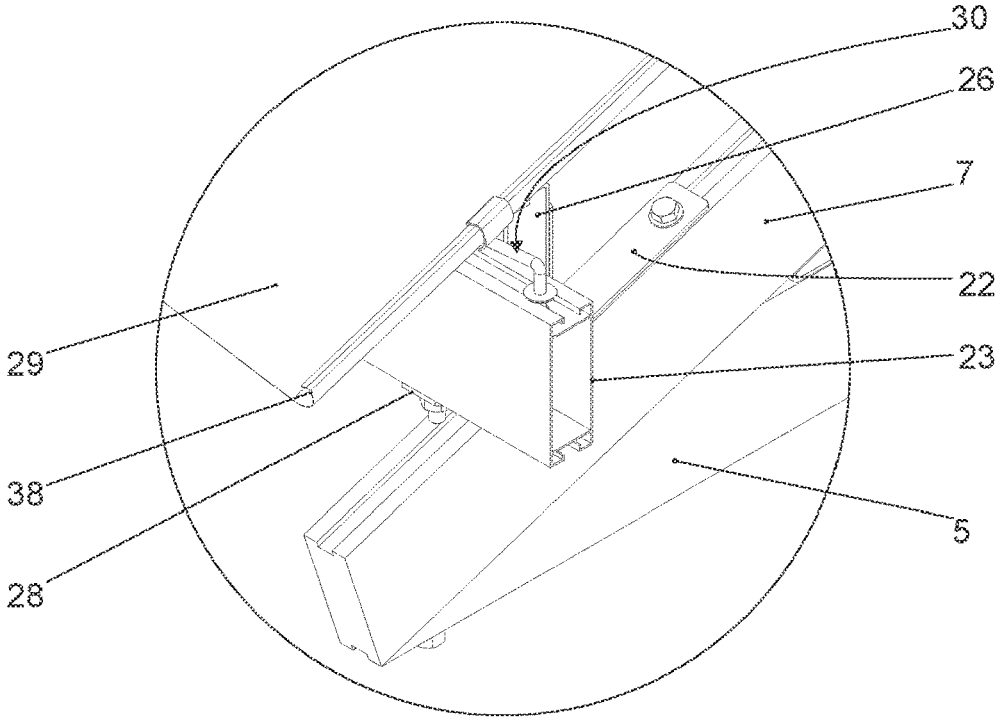
FIG. 5 shows an enlarged detail of the rotatable and compactable cover indicated as "D" in FIG. 1.
Figure 6:
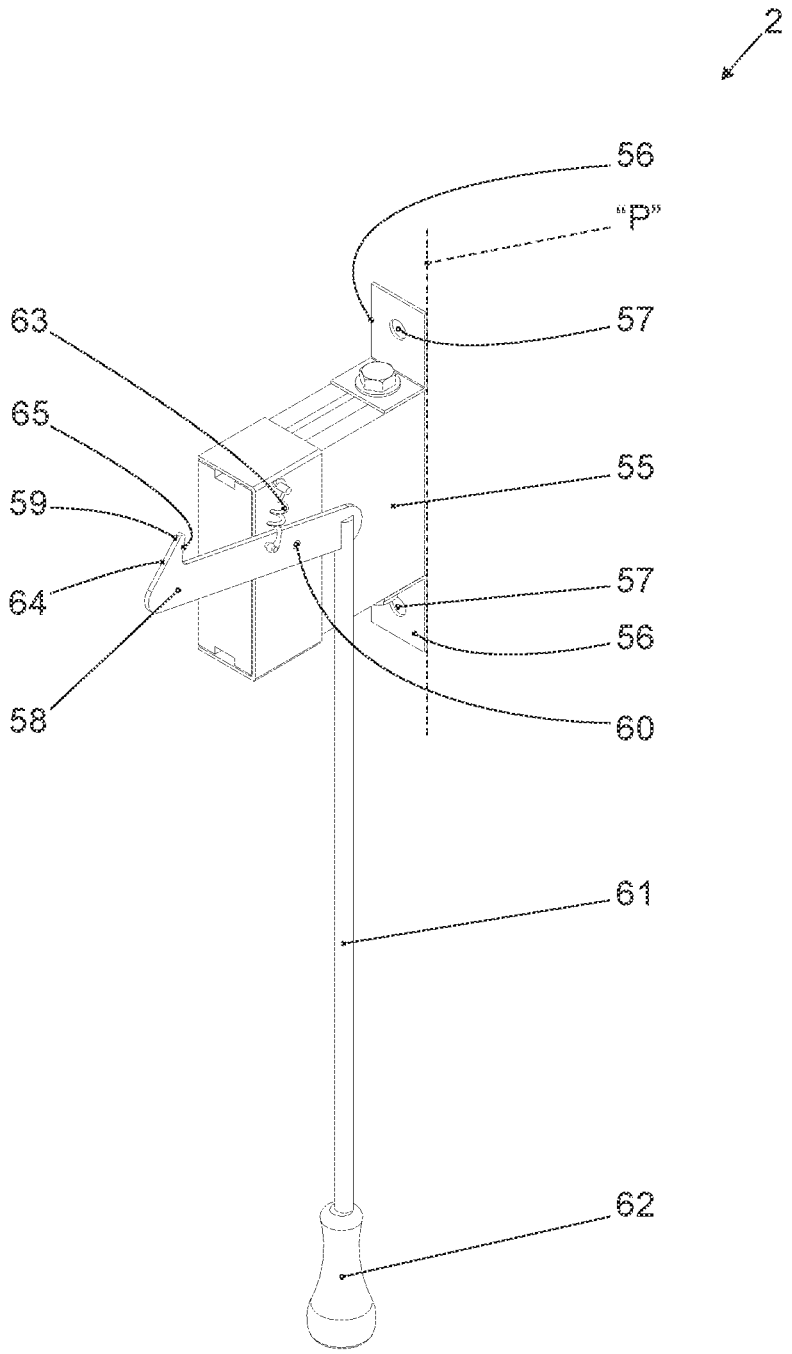
FIG. 6 shows an enlarged detail of the rotatable and compactable cover indicated as "E" in FIG. 1.
Figure 7:
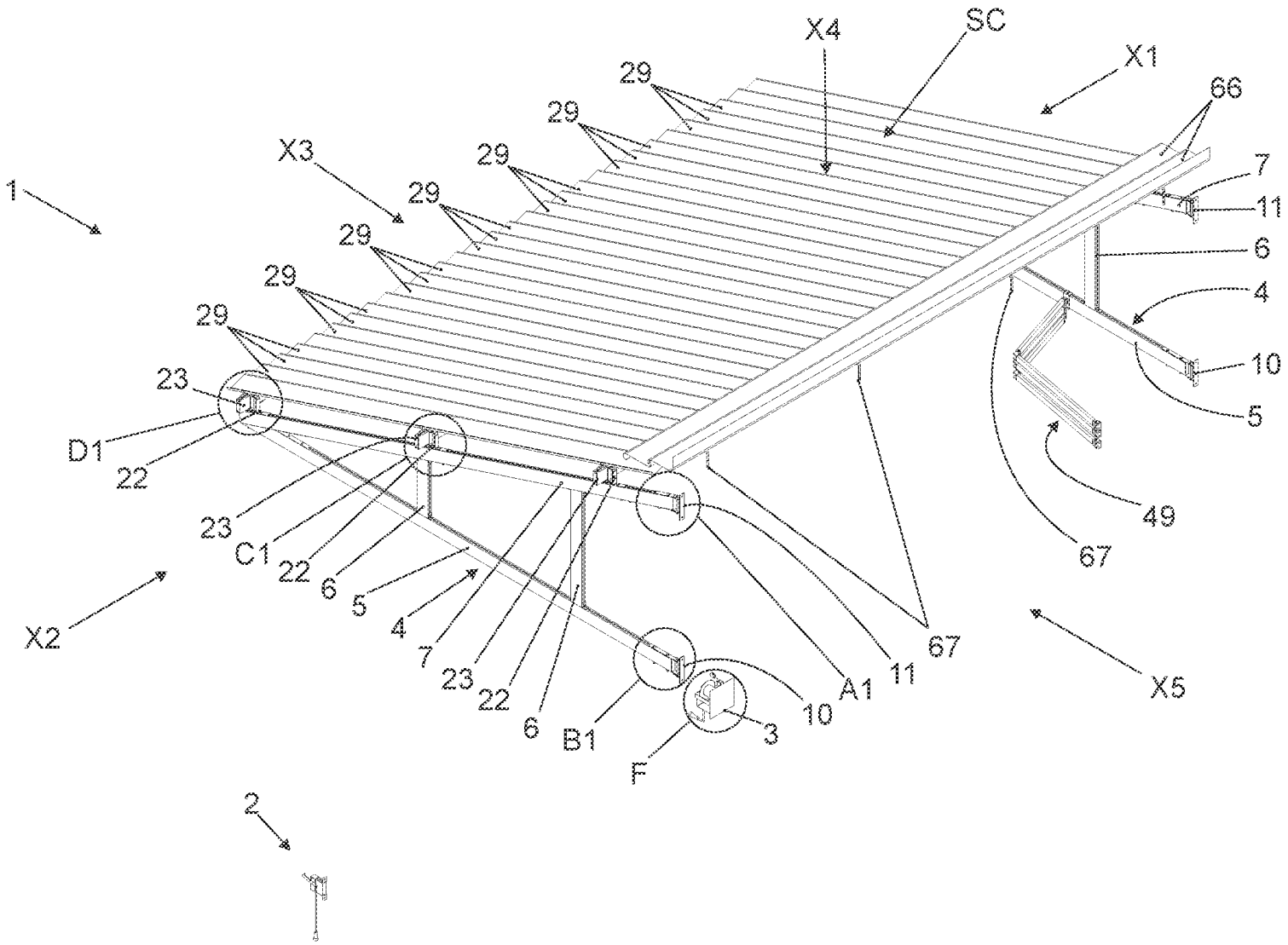
FIG. 7 shows a general, top, and rear view of the rotatable and compactable cover being fully extended.
Figure 8:
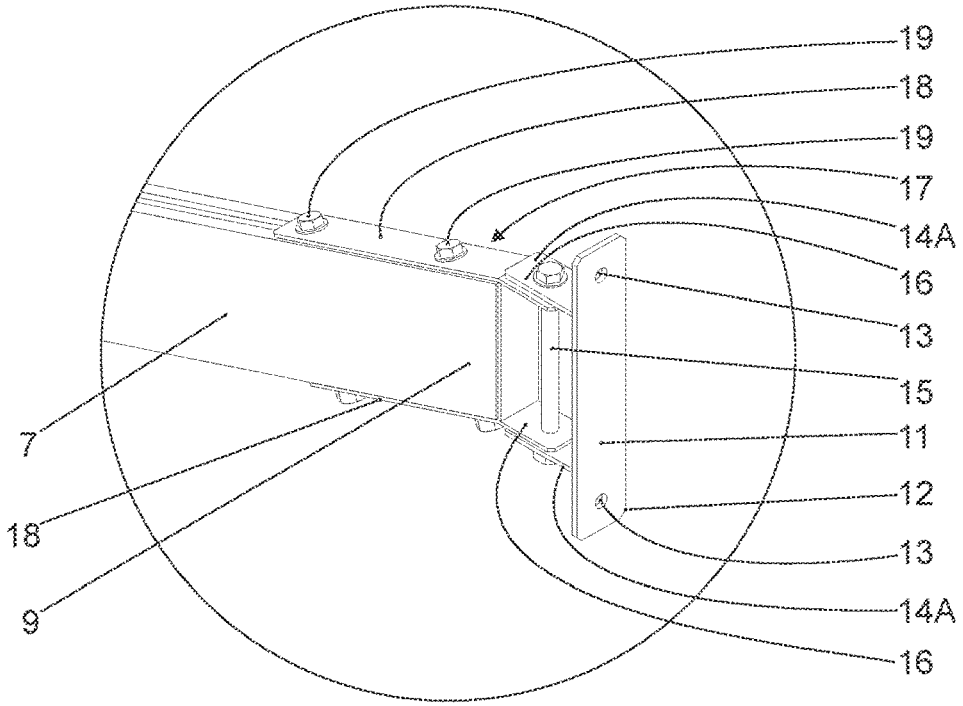
FIG. 8 shows an enlarged detail of the rotatable and compactable cover indicated as "A1" in FIG. 7.
Figure 9:
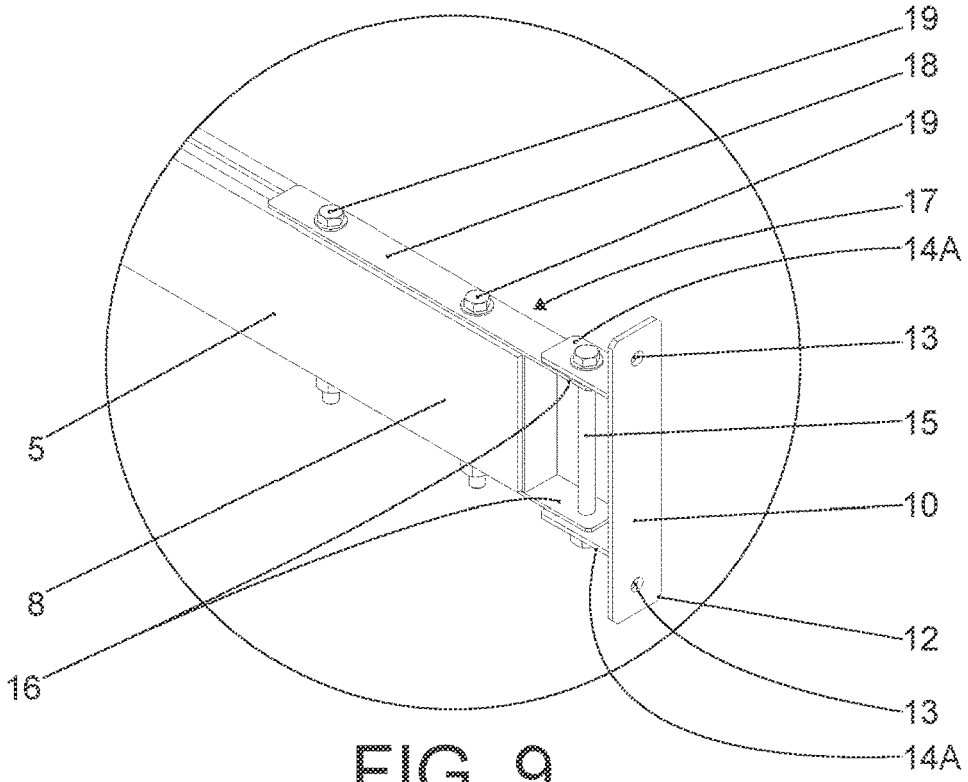
FIG. 9 shows an enlarged detail of the rotatable and compactable cover indicated as "B1" in FIG. 7.
Figure 10:
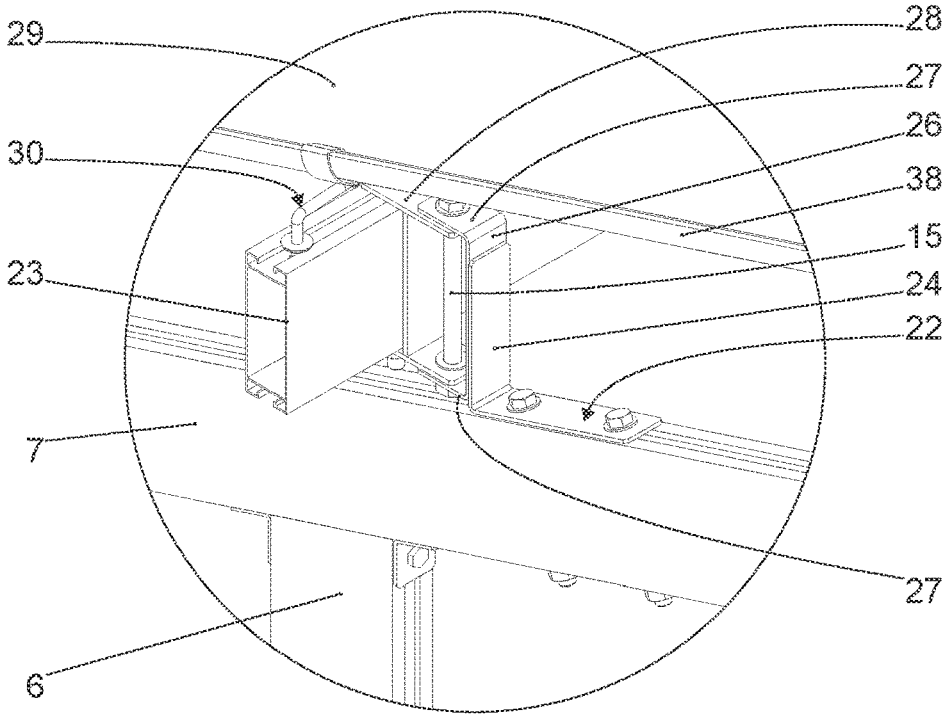
FIG. 10 shows an enlarged detail of the rotatable and compactable cover indicated as "C1" in FIG. 7.
Figure 11:
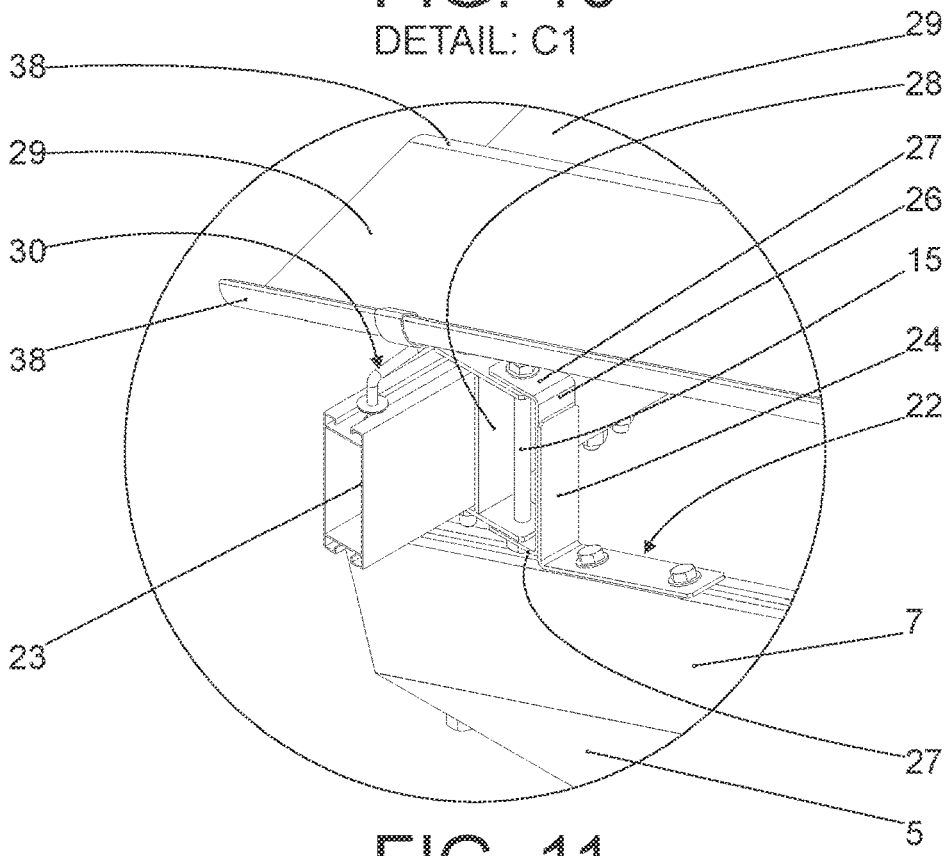
FIG. 11 shows an enlarged detail of the rotatable and compactable cover indicated as "D1" in FIG. 7.
Figure 12:
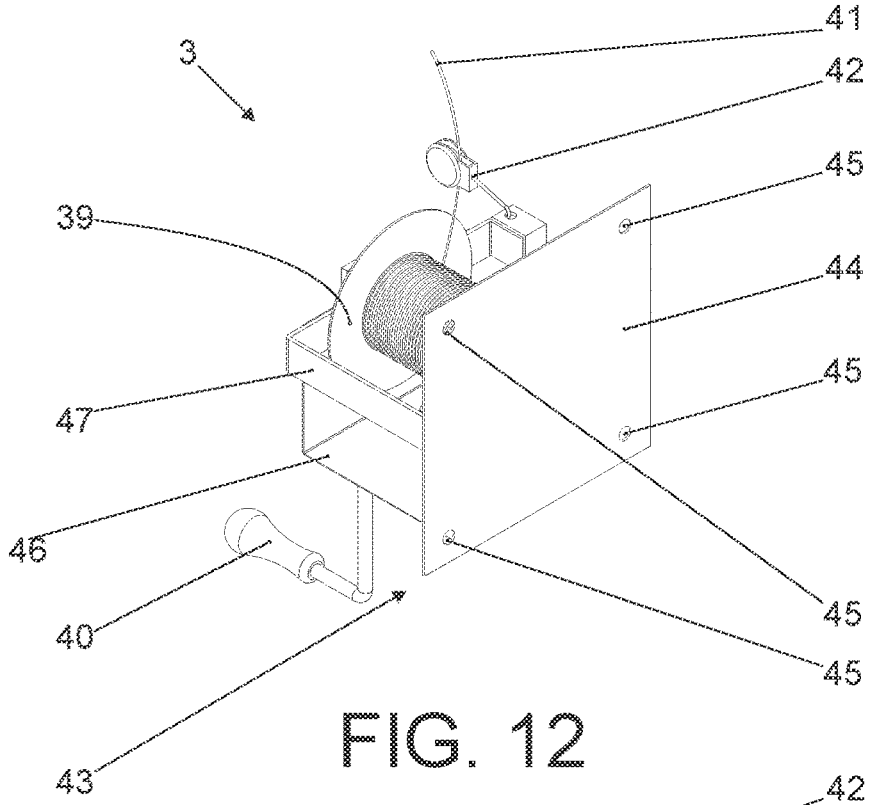
FIG. 12 shows an enlarged detail of the rotatable and compactable cover indicated as "F" in FIG. 7, which illustrates the cover retraction device.
Figure 12A:
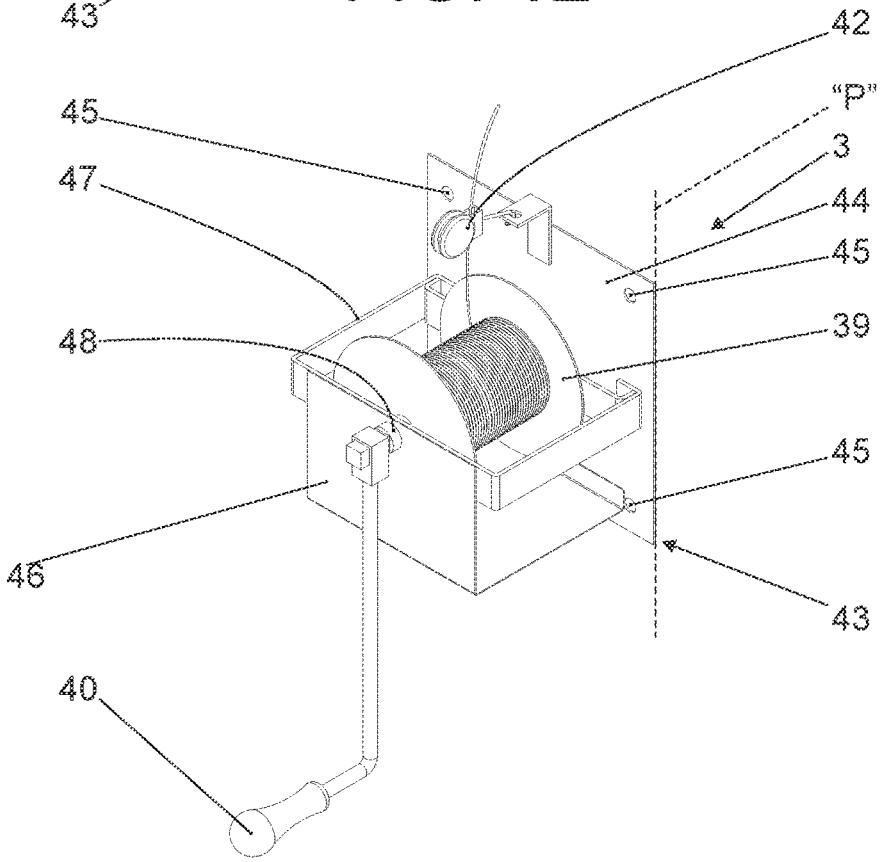
FIG. 12A shows a front view of the retraction device shown in FIG. 12.
Figure 13:
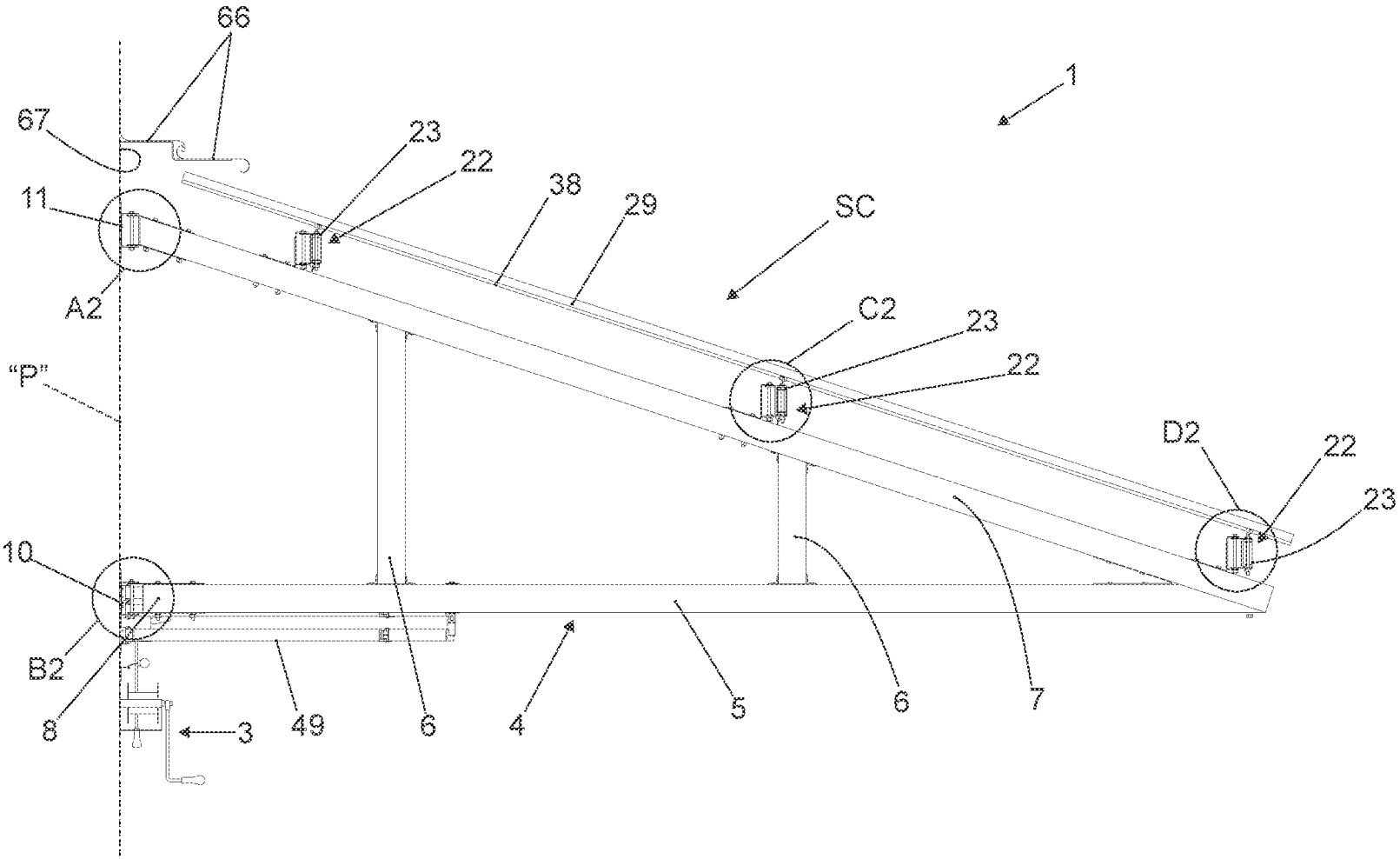
FIG. 13 shows a side view of the rotatable and compactable cover, side view taken according to the arrow X1 indicated in FIGS. 1 and 7.
Figure 14:
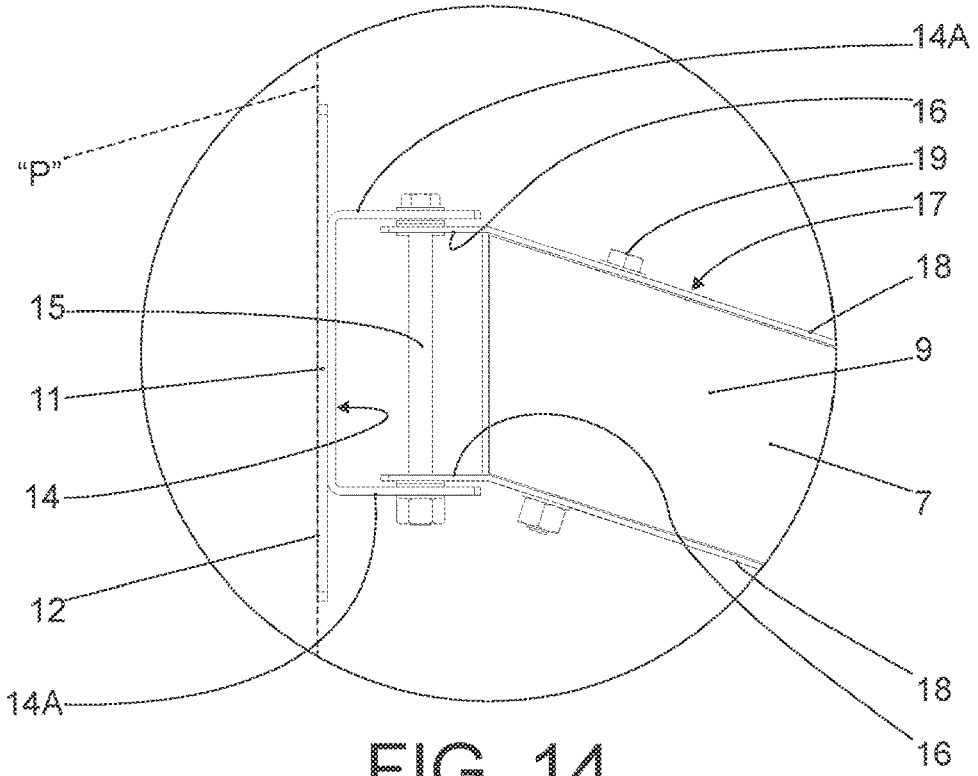
FIG. 14 shows an enlarged detail of the rotatable and compactable cover indicated as "A2" in FIG. 13.
Figure 15:
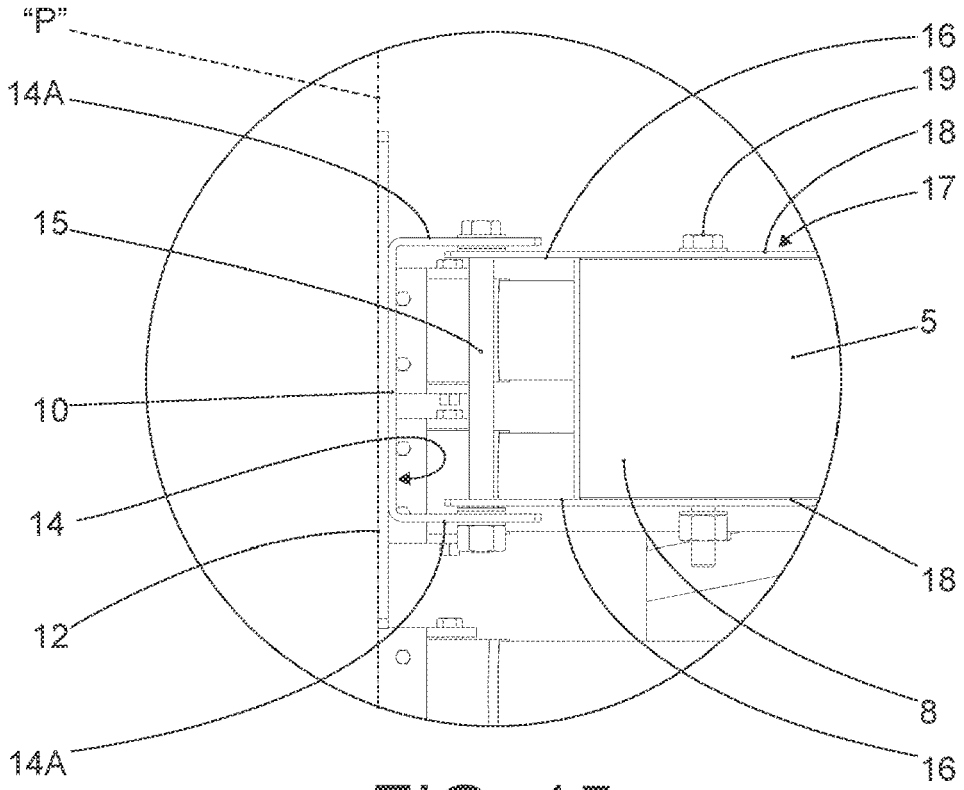
FIG. 15 shows an enlarged detail of the rotatable and compactable cover indicated as "B2" in FIG. 13.
Figure 16:
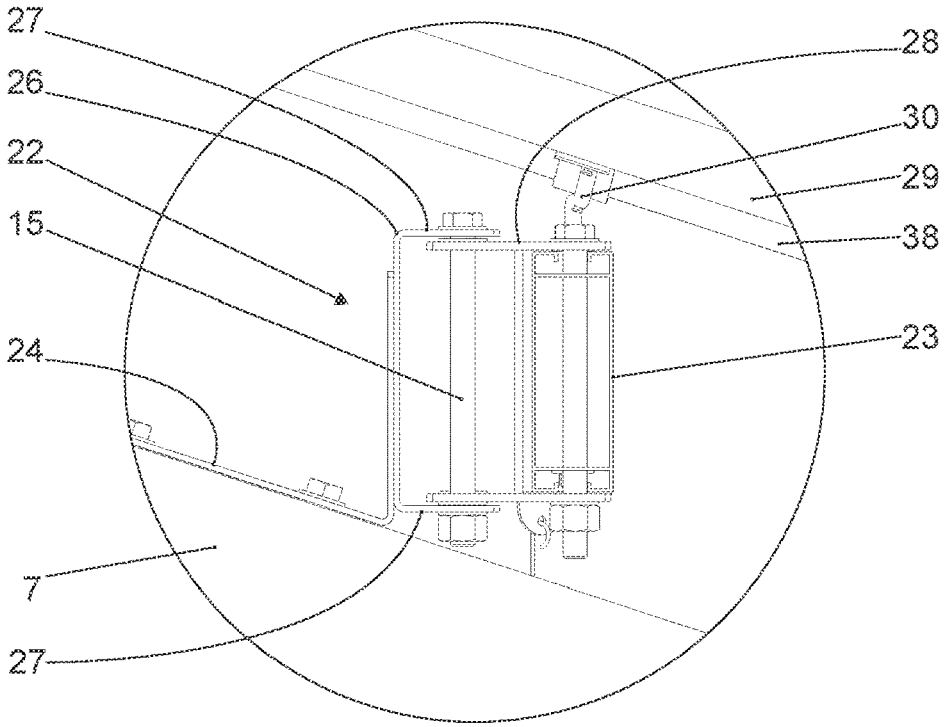
FIG. 16 shows an enlarged detail of the rotatable and compactable cover indicated as "C2" in FIG. 13.
Figure 17:
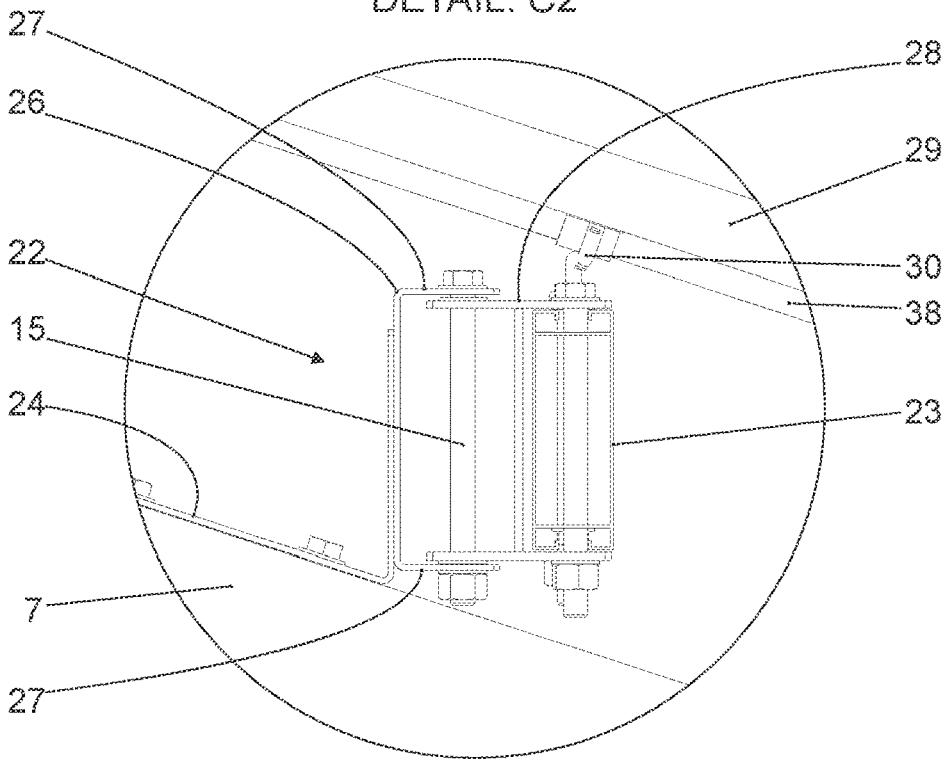
FIG. 17 shows an enlarged detail of the rotatable and compactable cover indicated as "D2" in FIG. 13.
Figure 18:
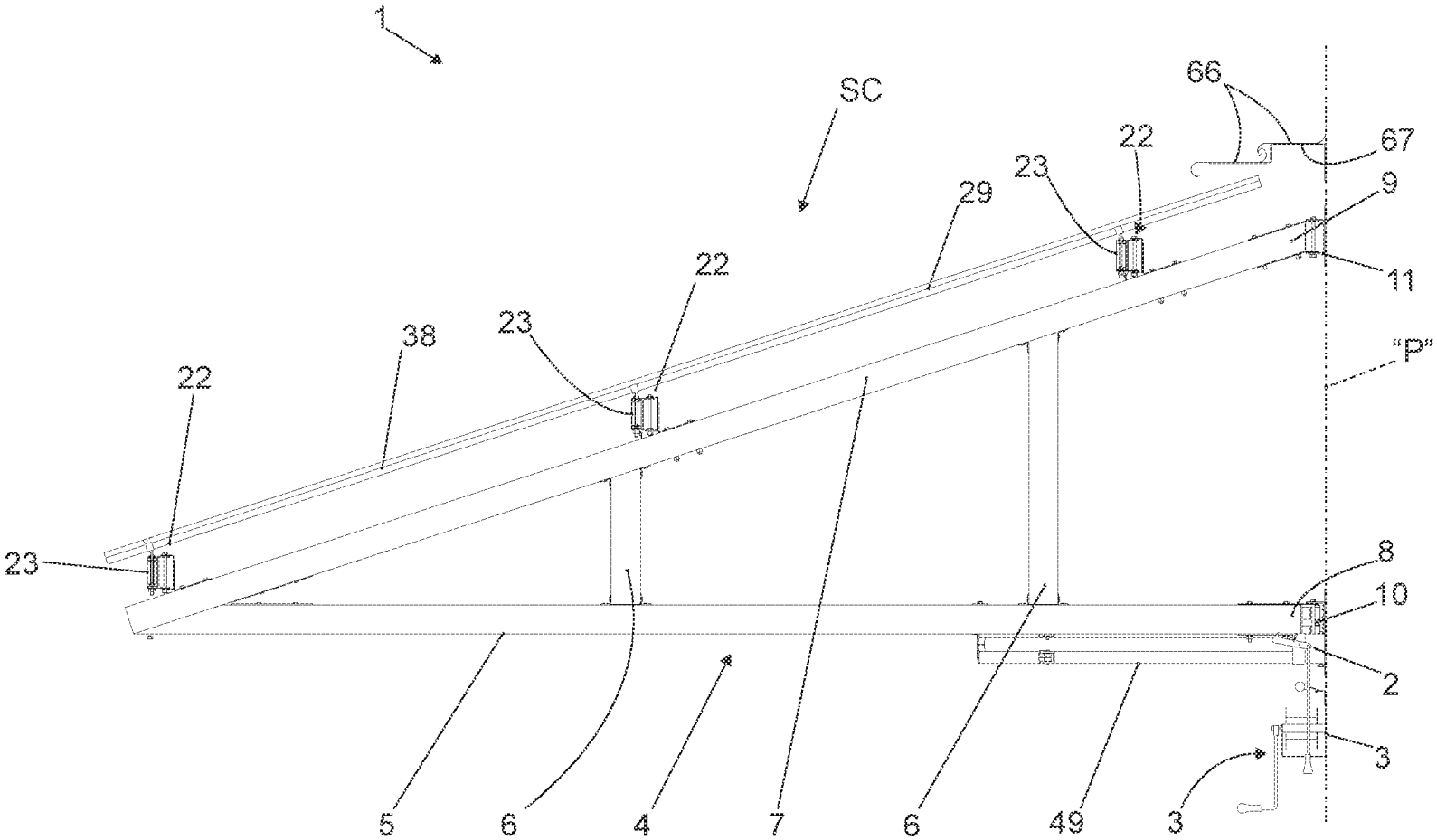
FIG. 18 shows a side view of the rotatable and compactable cover, the side view taken according to the arrow X2 indicated in FIGS. 1 and 7.
Figure 19:
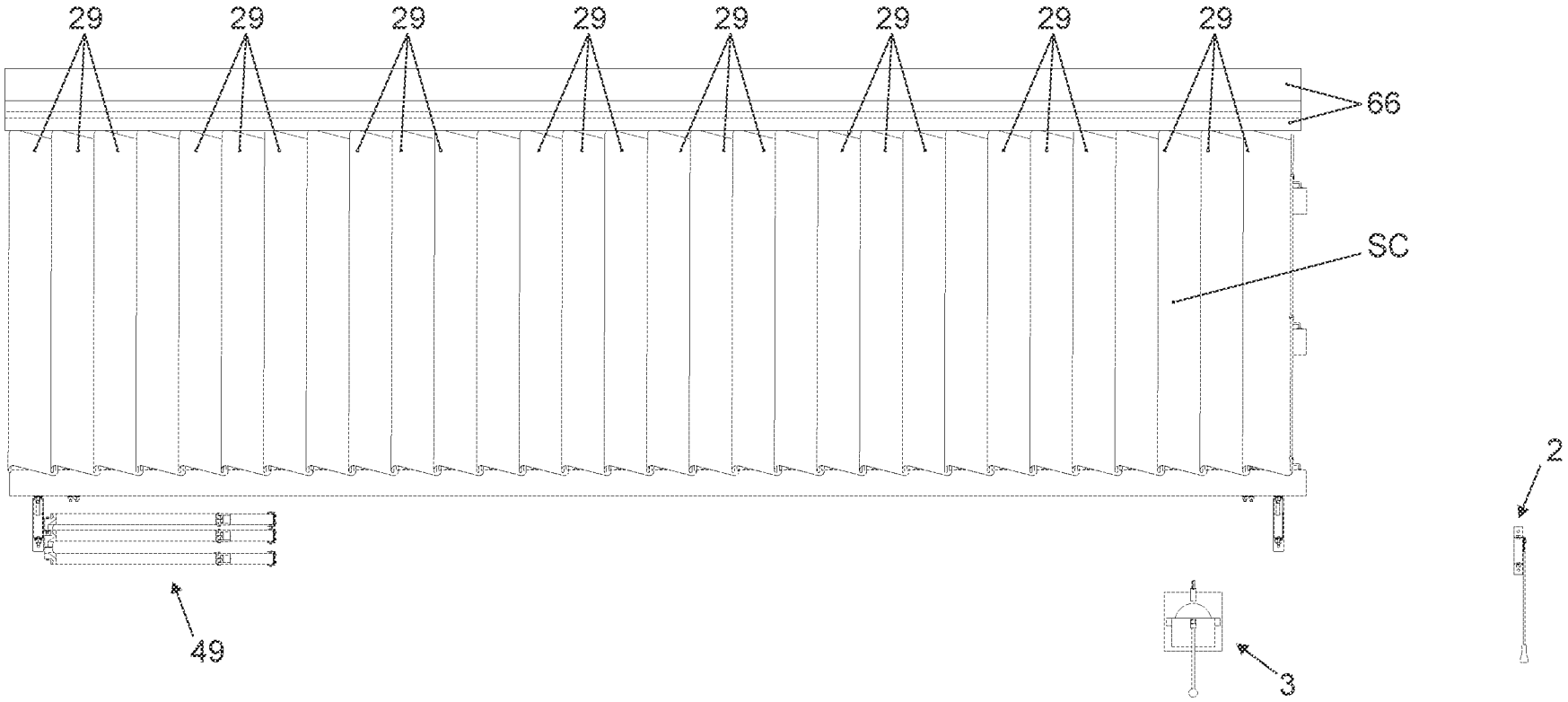
FIG. 19 shows a front view of the rotatable and compactable cover, the front view taken according to the arrow X3 indicated in FIGS. 1 and 7.
Figure 20:
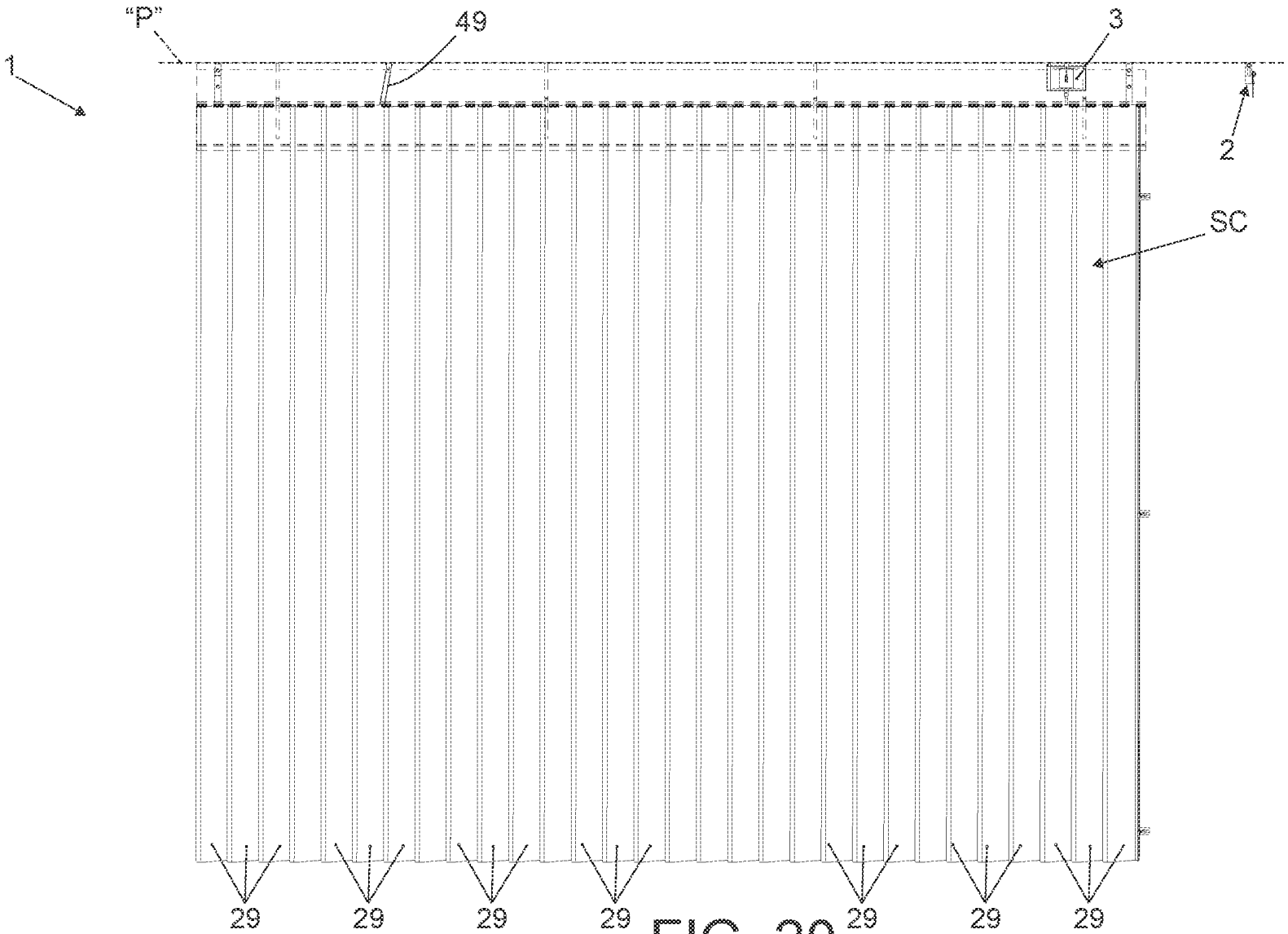
FIG. 20 shows a top view of the rotatable and compactable cover, the top view taken according to the arrow X4 indicated in FIGS. 1 and 7.

The rotatable and compactable cover object of this Invention Patent application, which is generally indicated by the numerical reference 1, has as accessories a locking device 2 (which can be seen in FIGS. 1, 2, 7, 13, 18, 19, 20, 21, 22, 23, 24, 25, 29, 33, 35, 38 and 54) and a retraction device 3 (which can be seen in FIGS. 1, 7, 12, 12A, 13, 18, 19, 20, 21, 22, 24, 25, 29, 33, 35, 41).

The rotatable and compactable cover 1 as well as the locking device 2 and the retraction device 3 are mounted in the same alignment on a wall or other suitable architectural structure.

The rotatable and compactable cover 1 has its structure based on the use of metal profiles and is essentially formed by a structure that has two movable supporting elements 4 (which can be seen in FIGS. 1, 7, 13, 18, 21, 22, 23, 24, 33, 34, 35, 43, 46, 47, 48, 49, 50, 51, 52, 53 and 54) made based on metallic profiles and that define a piece with an essentially triangular shape.

Each movable supporting element 4 is formed by the assembly of a lower bar 5 made with a metallic profile (aluminum) with a rectangular cross section from which two vertical bars 6 with different heights and made with the same profile start vertically upwards, which are connected to an upper bar 7, the latter being also made based on the same profile as the previous components.

In the configuration of the rotatable and compactable cover 1 (which can be seen in FIGS. 1 to 49 and 54), the lower bar 5 is a horizontal element while the upper bar 7 is an angled element, said two bars 5 and 7 converging to form an essentially triangular contour, defining two of the edges of the triangular contour, where the third edge of this Figure is defined by the plane of the wall or architectural structure that will receive the assembly of the rotatable and compactable cover 1.

In the assembly configurations of the rotatable and compactable cover 1 shown in FIGS. 50, 51, 52 and 53, the lower bar 5 has an upward slope and converges to find the upper bar 7, also tilted upwards.

The ends 8 and 9, respectively, of the lower 5 and upper 7 bars receive the assembly of joint terminals 10 and 11 (which can be seen in FIGS. 1, 2, 3, 7, 8, 9, 13, 14, 18, 22, 23, 24, 25, 26, 27, 32, 33, 35, 45, 46, 48, 49, 50, 51, 52, 53 and 54), which are basically identical in terms of construction, varying only in regard to the adequacy of the angle shown by the lower 5 and upper 7 bars.

The joint terminals 10 and 11 have a vertical plate 12 equipped with holes 13 for screwing (not shown), with which the joint terminals 10 and 11 are fixed to the wall or other architectural structure that will receive the assembly of the rotatable and compactable cover 1, the horizontal flaps 14A of a "C" shaped plate 14 starts from the front face of the vertical plate 14, being crossed by a vertical axis 15 in the form of a screw that also crosses the ends of the protruding flaps 16 of an assembly structure 17, which is traversed on its long flaps 18 by screws 19 provided with washers and nut, which also traverse the end of bars 5 and 7. The vertical axis 15 and screws 19 have washers 20 and nuts 21.

The axis 15 constitutes the point around which the joint of terminals of the assembly structure 17 occur and, consequently, of the bars 5 and 7 that form the main structure of the movable supporting elements 4.

In the joint terminal 10, the long flaps 18 are aligned with the protruding flaps 16, since the lower bar 5 is horizontal, while in the joint terminal 11 the protruding flaps 16 form an angle with the corresponding long flaps 18 in face of the angle shown by the top bar 7.

Joint supports 22 (which can be seen in FIGS. 4, 5, 7, 10, 11, 13, 16, 17, 18, 19, 22, 25, 26, 27, 28, 29 and 35) are mounted on the upper face of the upper bar 7, on which, in turn, the movable side rails 23 (which can be seen in FIGS. 4, 5, 7, 10, 11, 13, 16, 17, 18, 19, 22, 25, 26, 27, 28, 29 and 35) are mounted.

Each joint support 22 is formed by a folded plate 24 provided with holes 25 and that is joined to a "C" shaped plate 26 from which horizontal flaps 27 also provided with holes 25 start, with the "C" shaped plate being traversed by a vertical axis 15 in the form of a screw, which also traverses an assembly component 28 that receives the assembly of the movable side rail 23.

Fixing of the joint support 22 to the upper bar 7 is done by means of screws 19, also being a screw 19 and its respective washers 20 and nuts 21 used to fix the assembly component 28 to the movable side rails 23.

Figure 22:
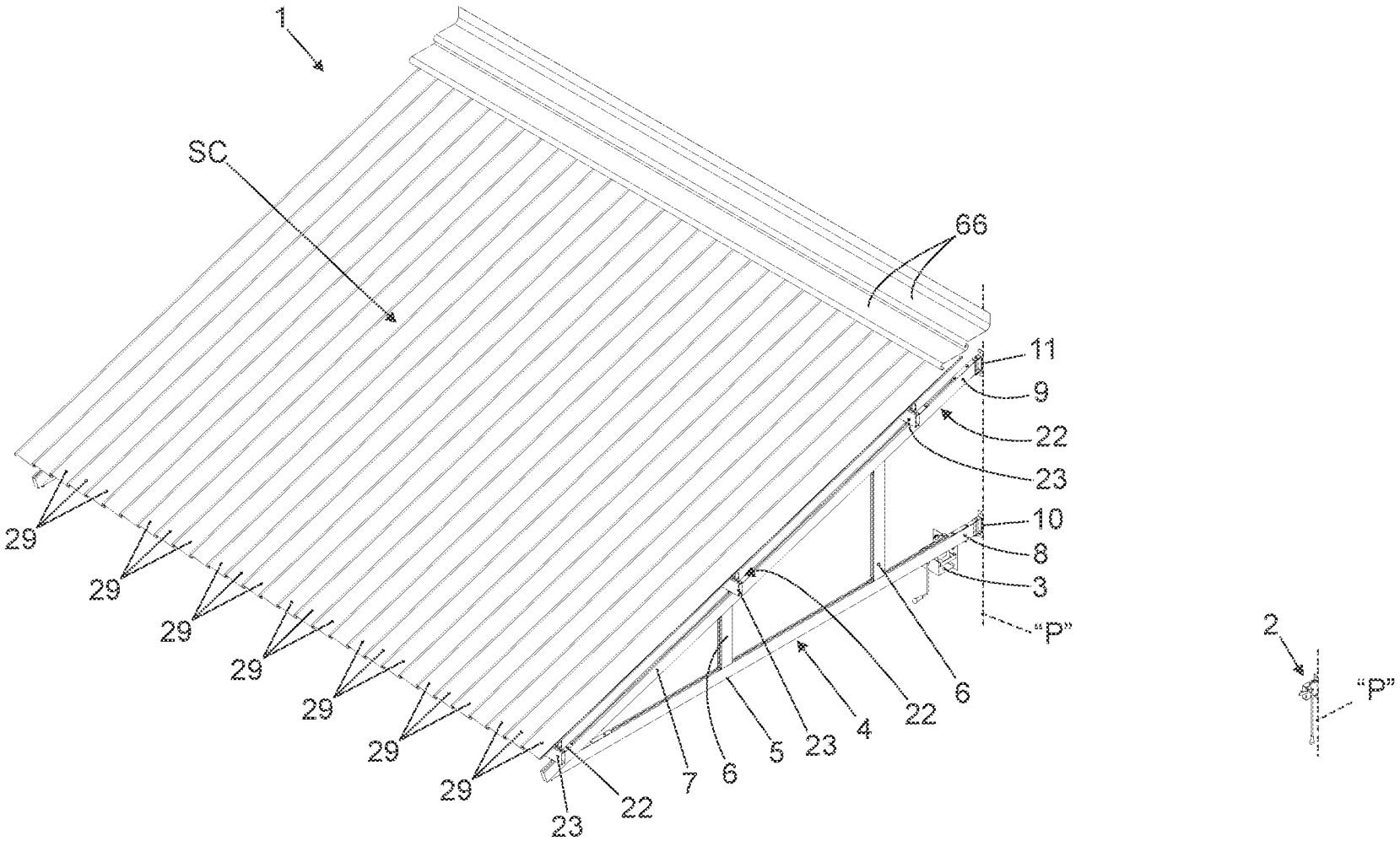
FIGS. 22, 23 and 24 illustrate the rotatable and compactable cover in general, top and front views, according to its sequential condition of movement from its "fully extended" condition (FIG. 22), through its "partially extended" condition (FIG. 23) up to its "fully folded and compacted" condition (FIG. 24)
Figure 23:
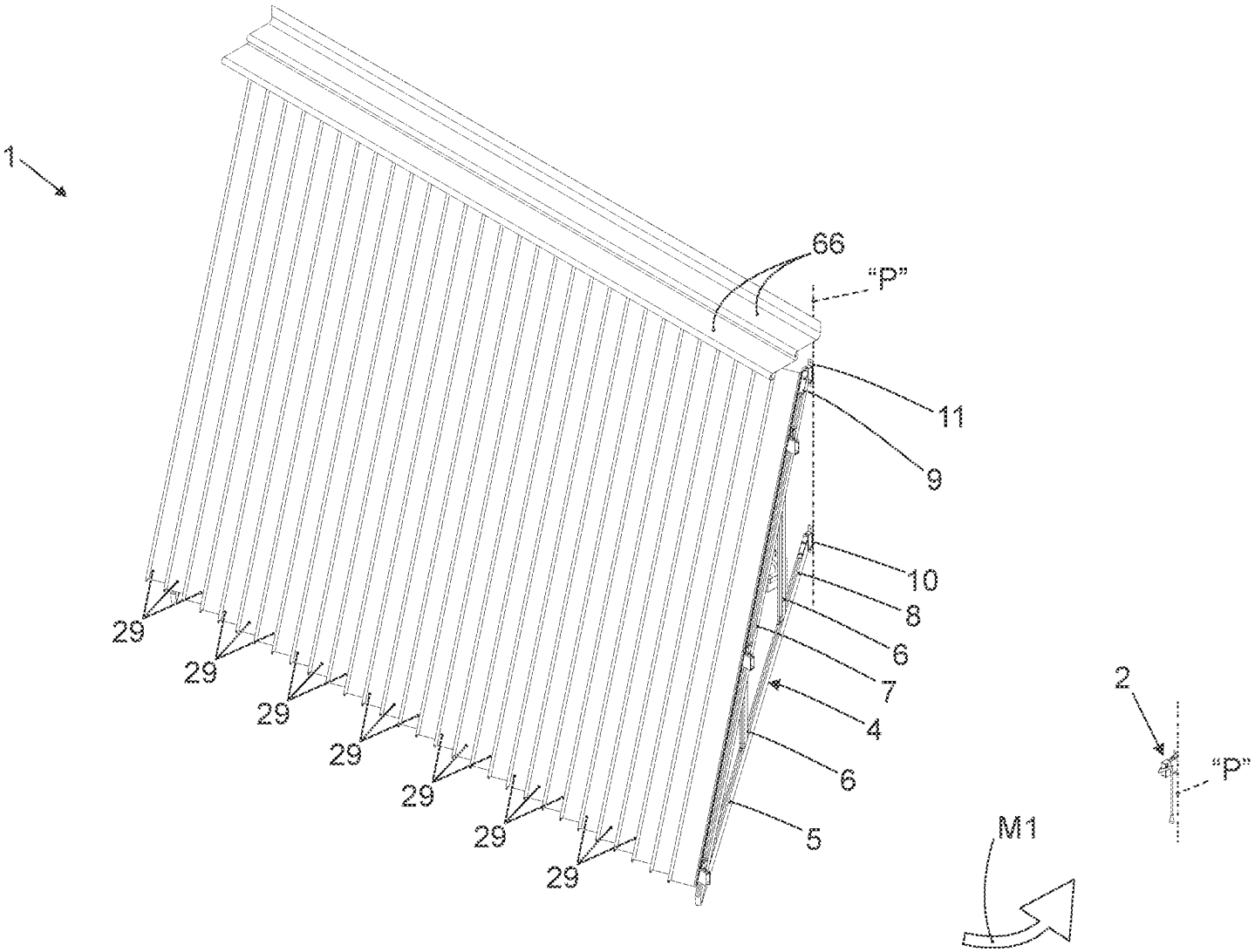
Figure 24:
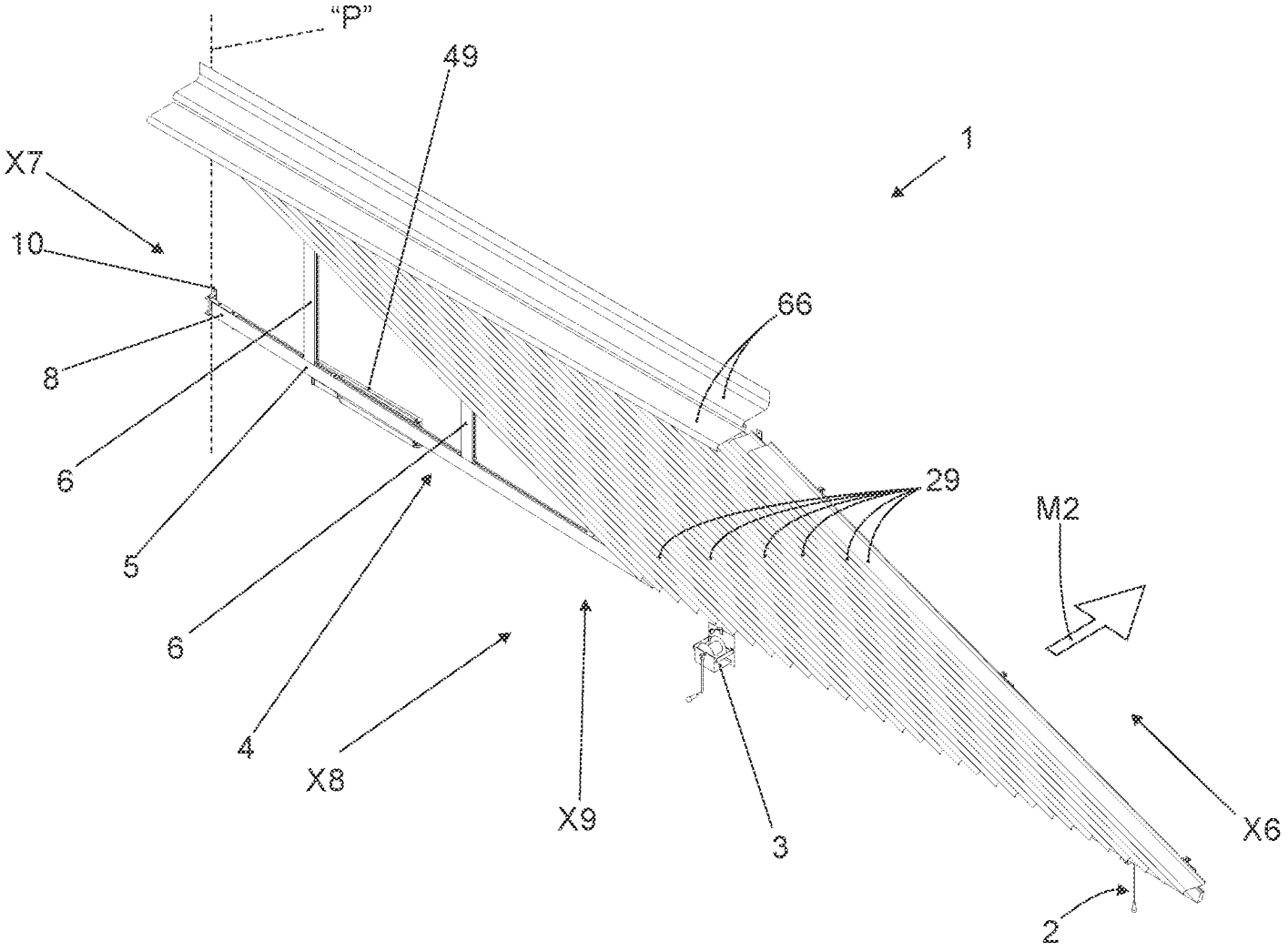
Figure 25:
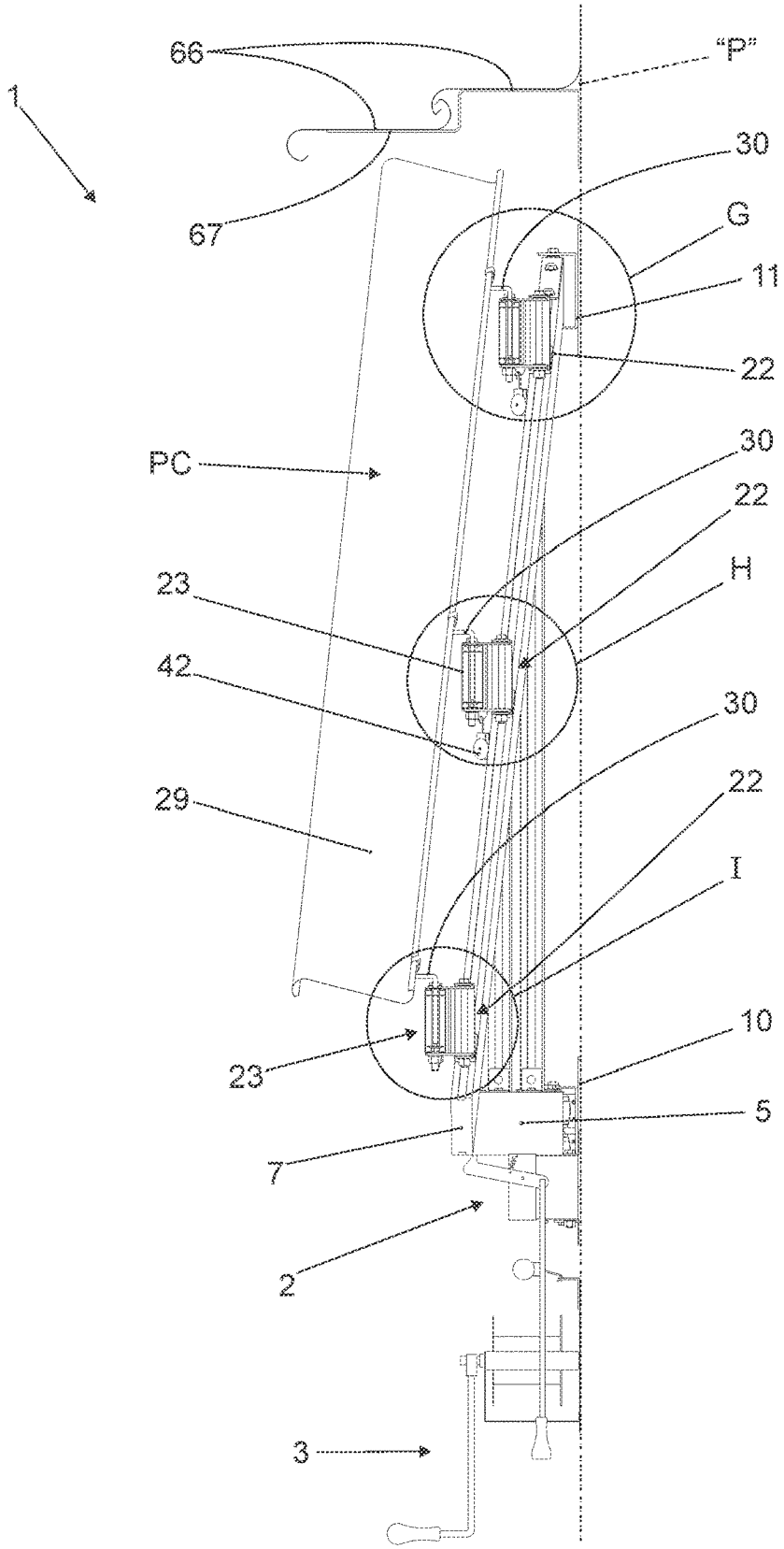
FIG. 25 shows a side view of the rotatable and compactable cover in its "fully folded and compacted" condition, the side view taken according to the arrow X6 indicated in FIG. 24.
Figure 26:
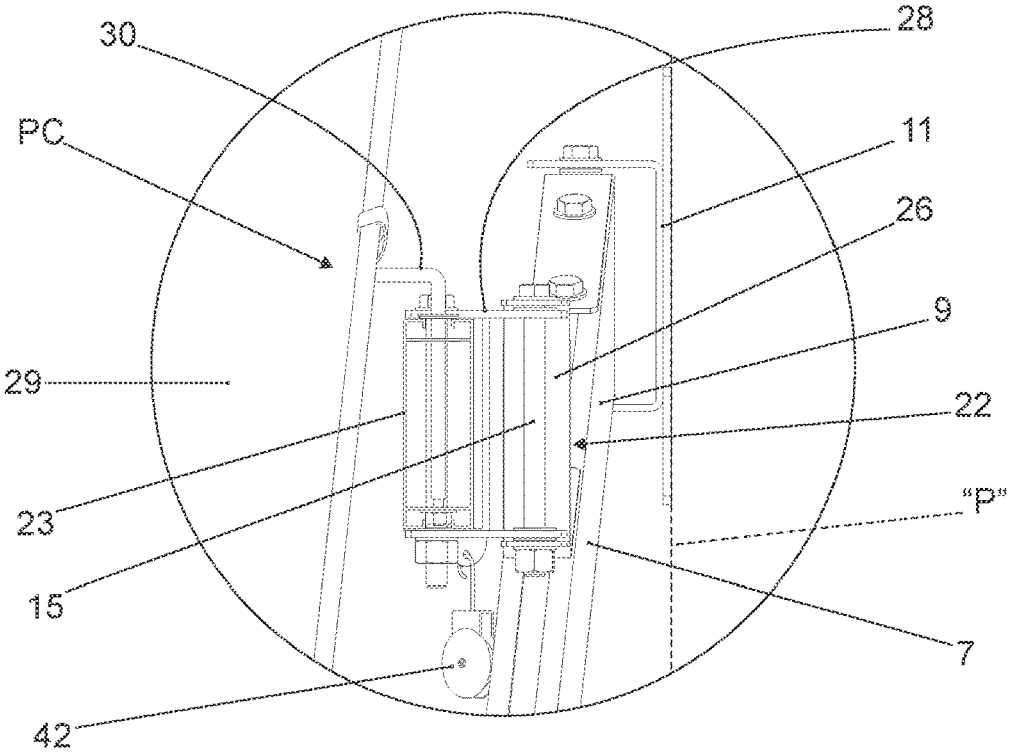
FIG. 26 shows an enlarged detail of the rotatable and compactable cover indicated as "G" in FIG. 25.
Figure 27:
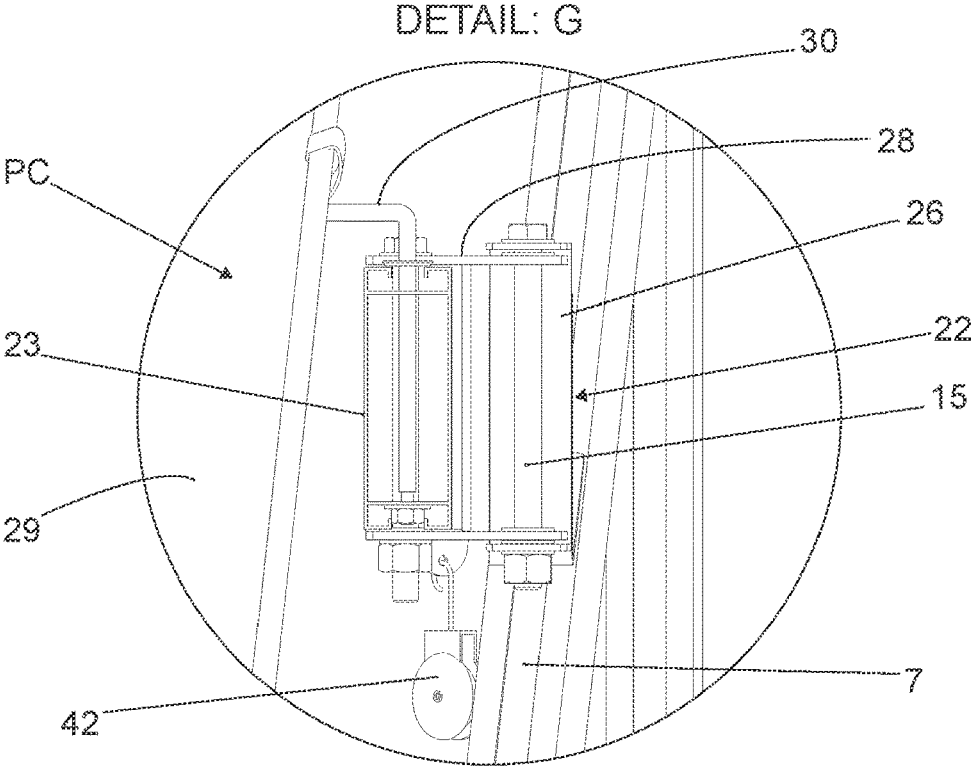
FIG. 27 shows an enlarged detail of the rotatable and compactable cover indicated as "H" in FIG. 25.
Figure 28:
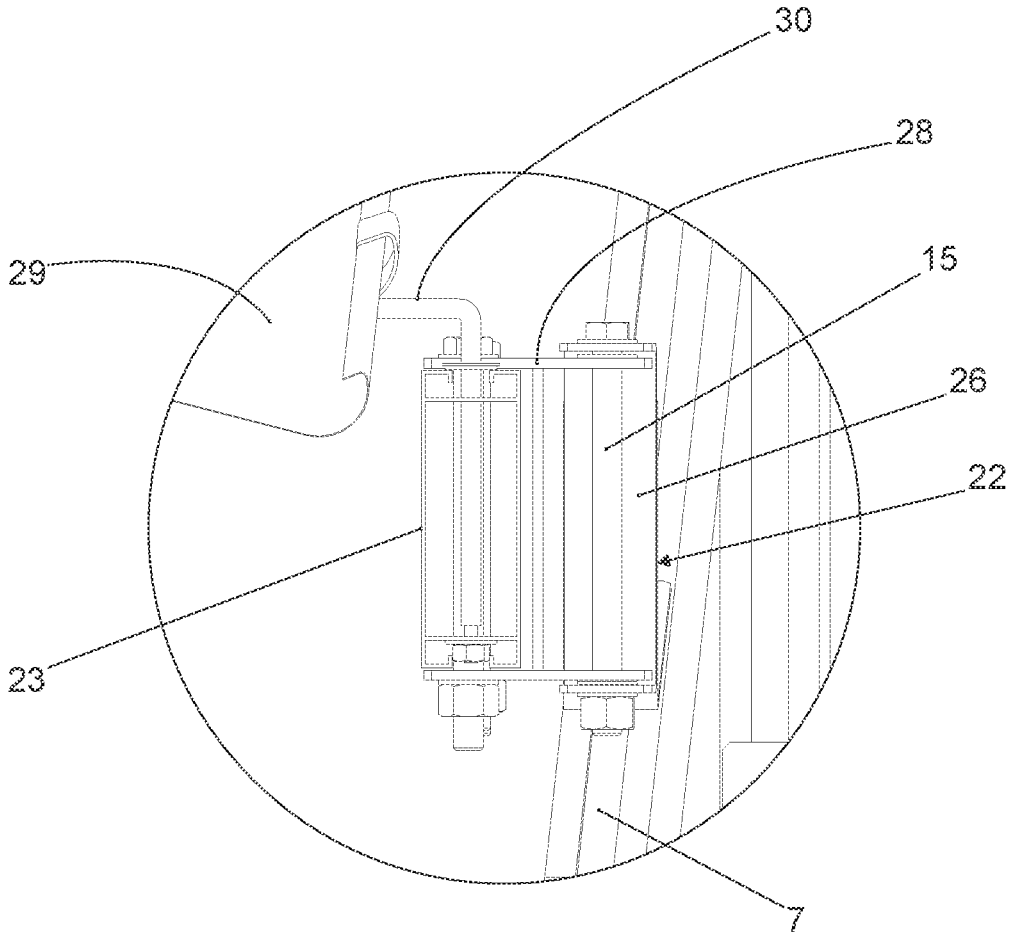
FIG. 28 shows an enlarged detail of the rotatable and compactable cover indicated as "I" in FIG. 25.
Figure 29:
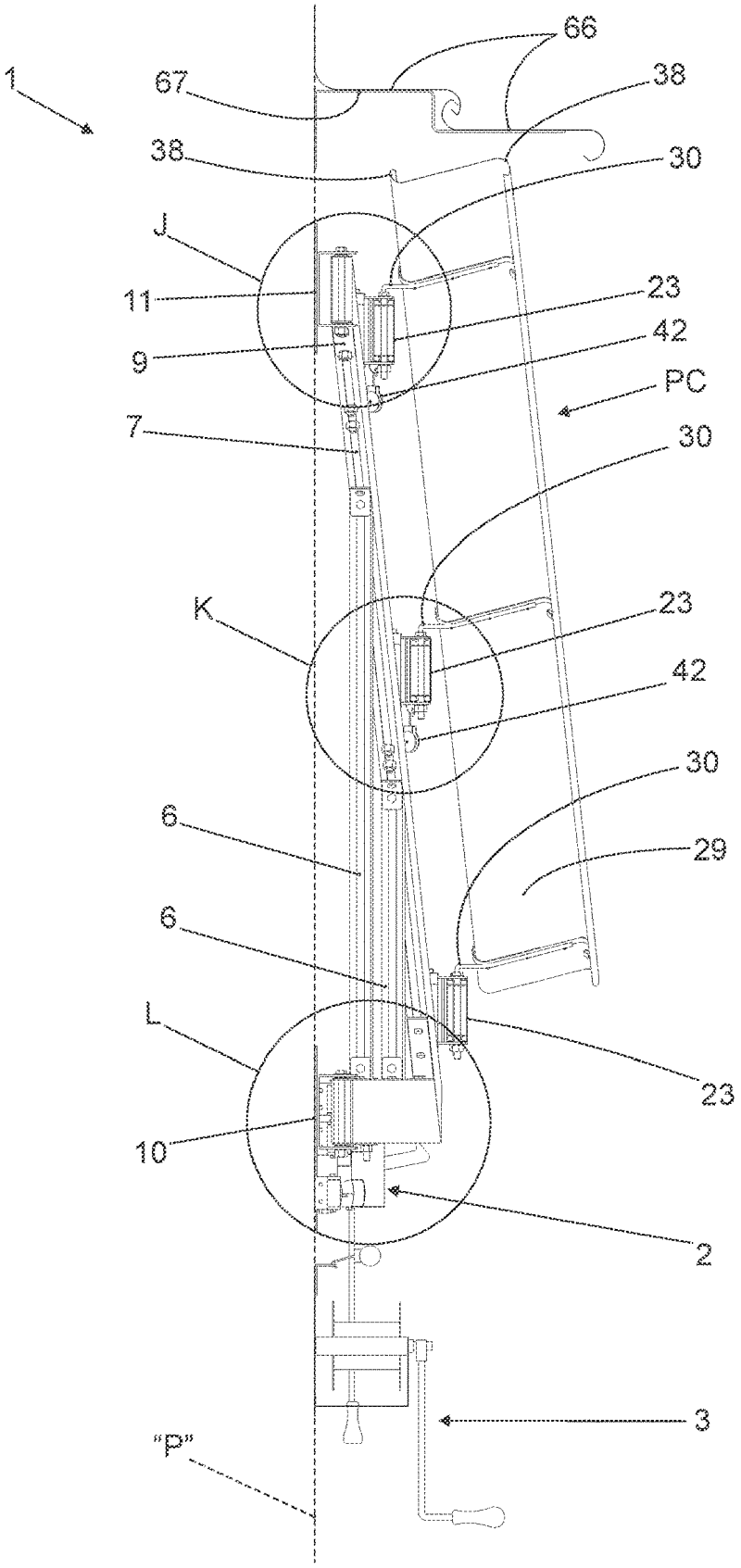
FIG. 29 shows a side view of the rotatable and compactable cover in its "fully folded and compacted" condition, the side view taken according to the arrow X7 indicated in FIG. 24.
Figure 30:
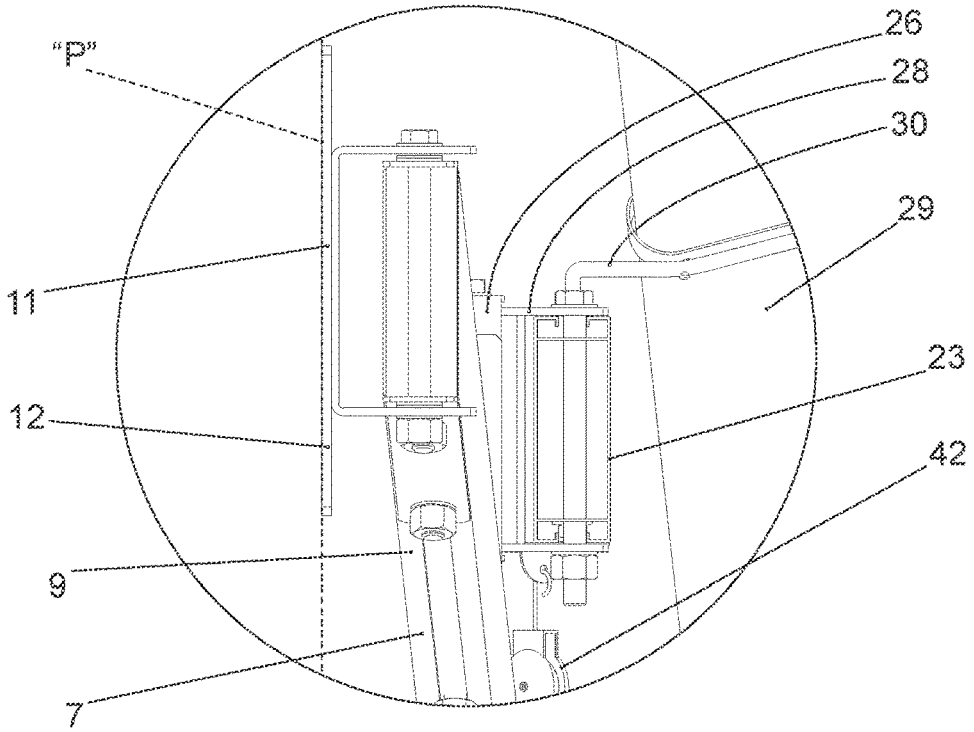
FIG. 30 shows an enlarged detail of the rotatable and compactable cover indicated as "J" in FIG. 29.
Figure 31:
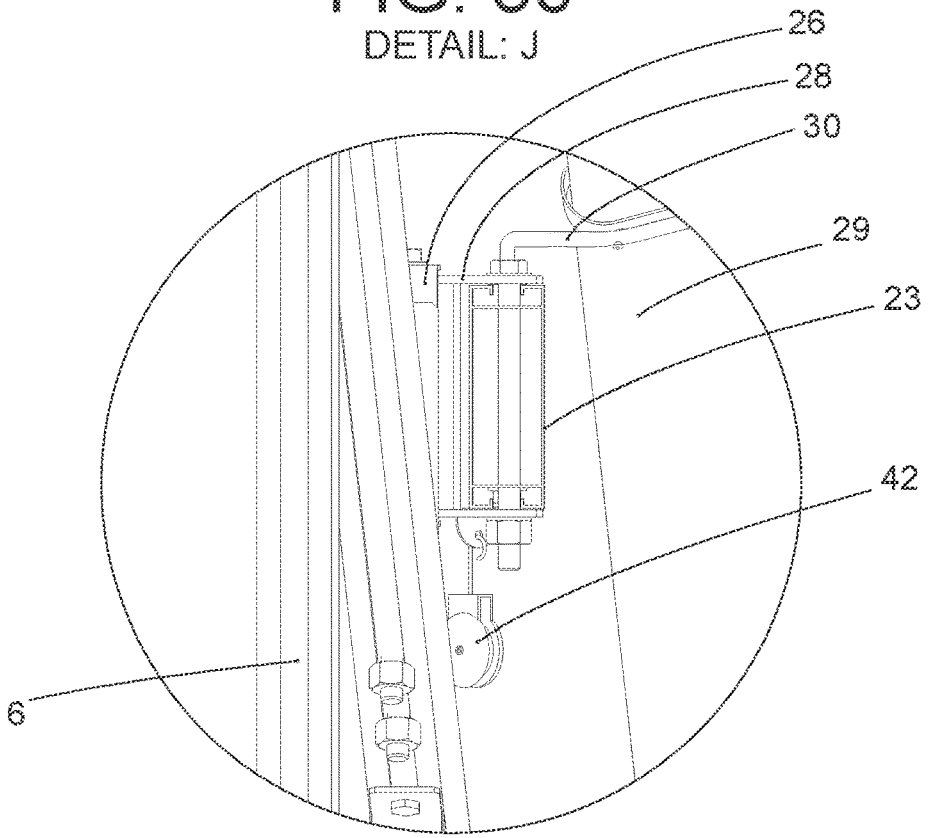
FIG. 31 shows an enlarged detail of the rotatable and compactable cover indicated as "K" in FIG. 29.
Figure 32:
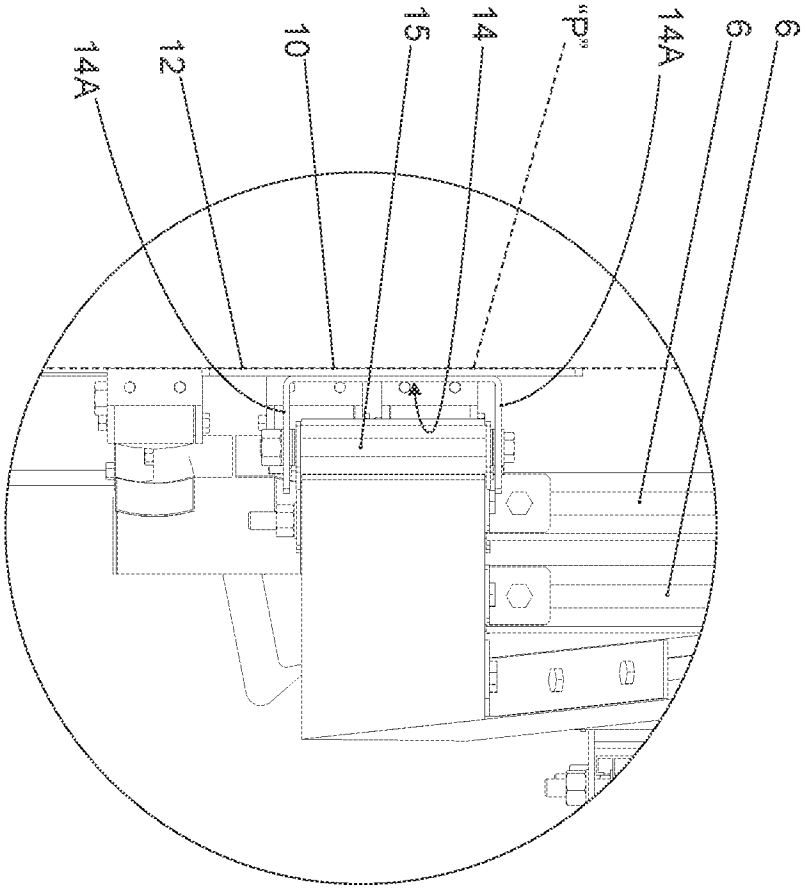
FIG. 32 shows an enlarged detail of the rotatable and compactable cover indicated as "L" in FIG. 29.
Figure 33:
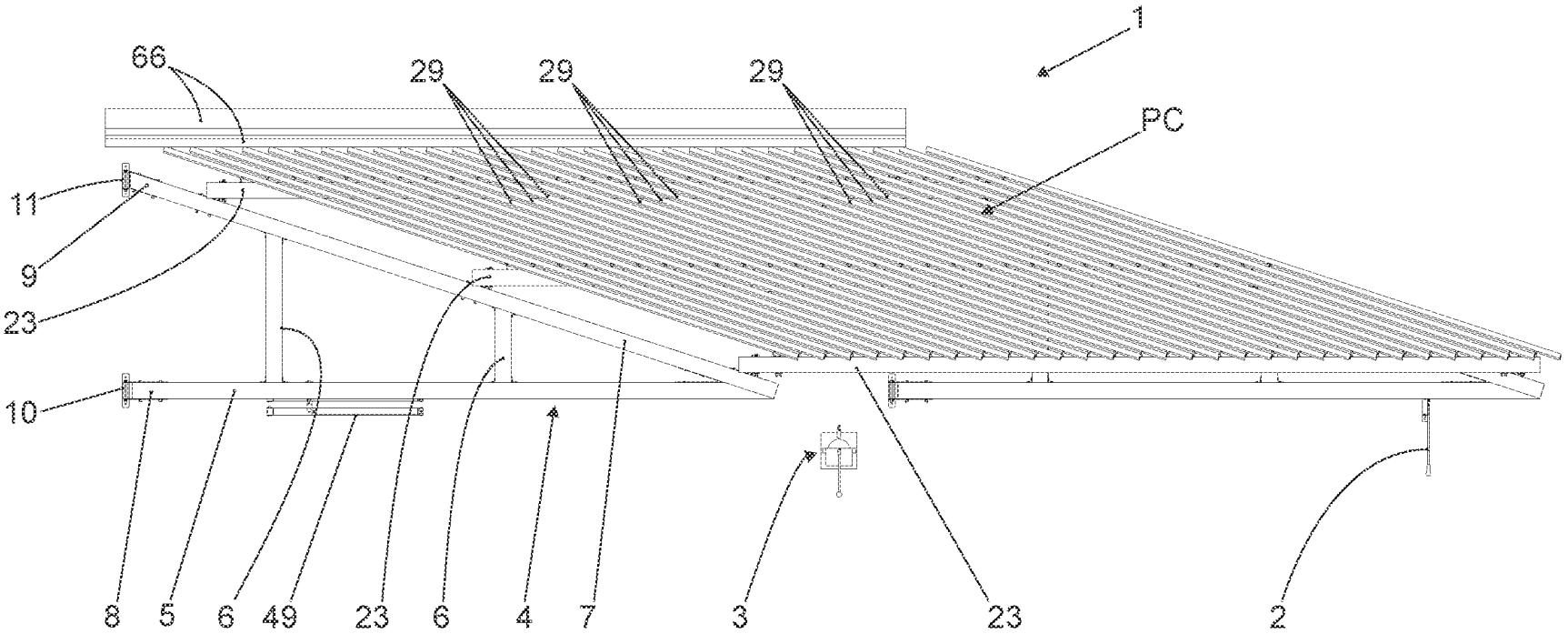
FIG. 33 shows a front view of the rotatable and compactable cover in its "fully folded and compacted" condition, the front view taken according to the arrow X8 indicated in FIG. 24.
Figure 34:
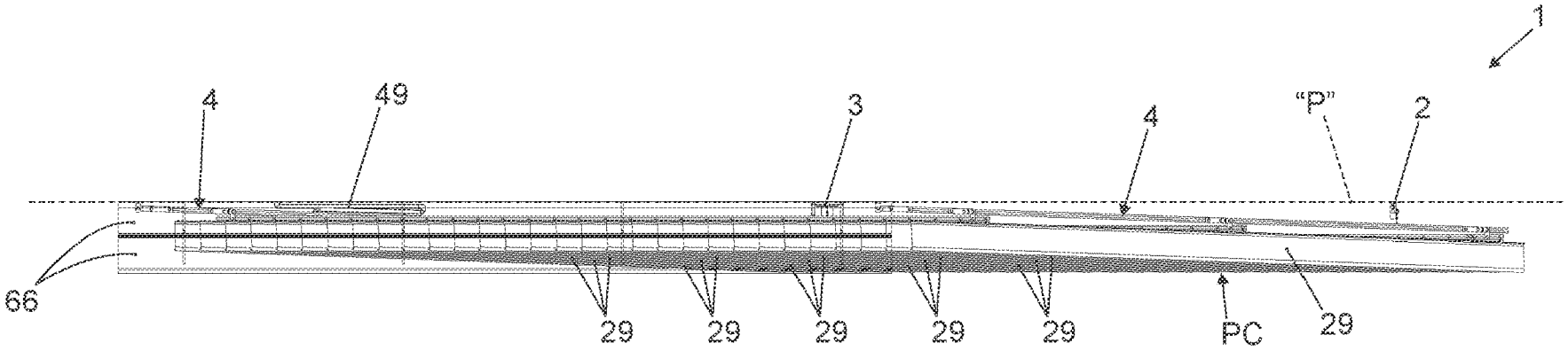
FIG. 34 shows a bottom view of the rotatable and compactable cover in its "fully folded and compacted" condition, the bottom view taken according to the arrow X9 indicated in FIG. 24.
Figure 35:
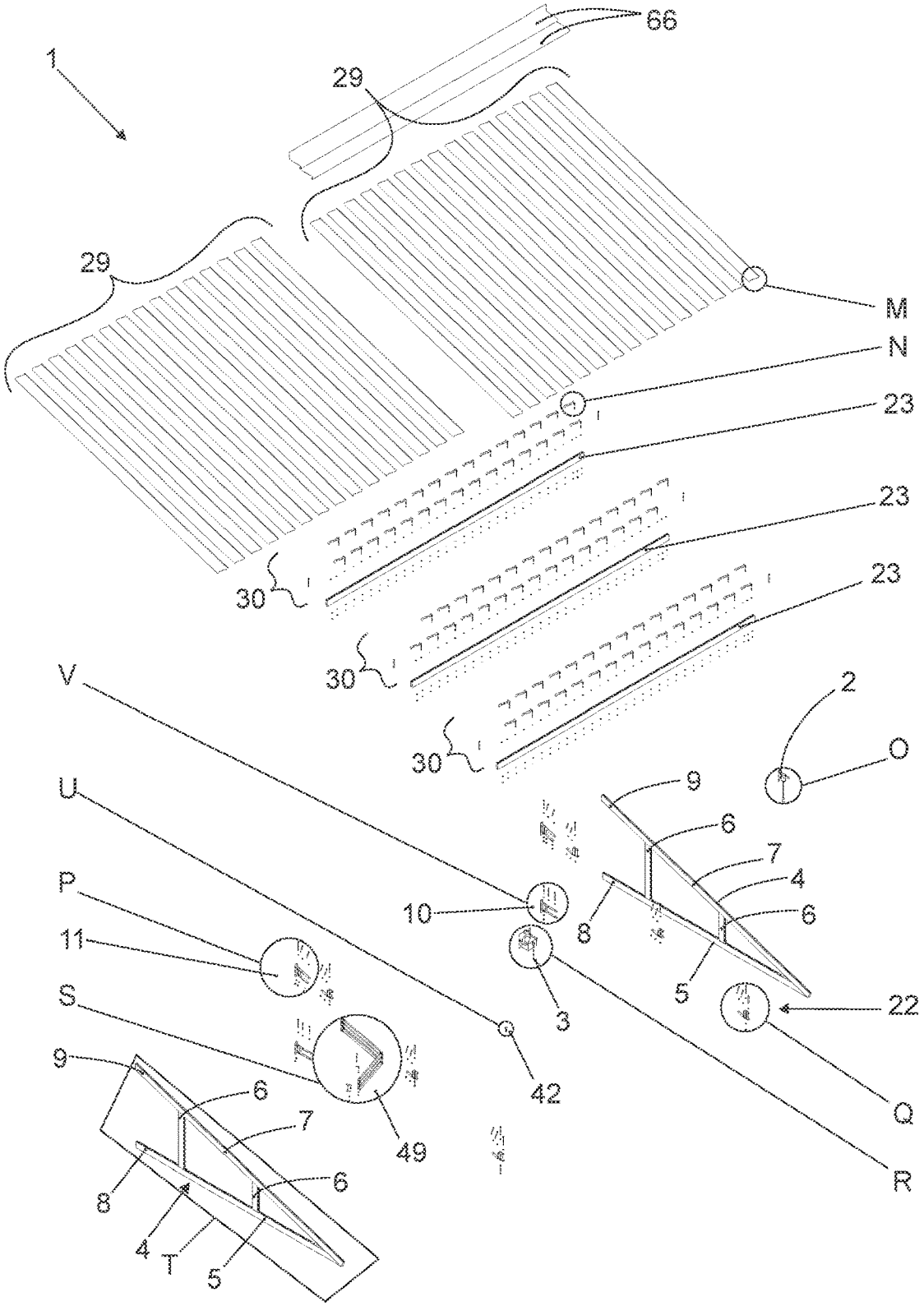
FIG. 35 shows a general and exploded perspective view in an upper and frontal angle of the rotatable and compactable cover, showing its different components separately, but in relative positioning.
Figure 36:
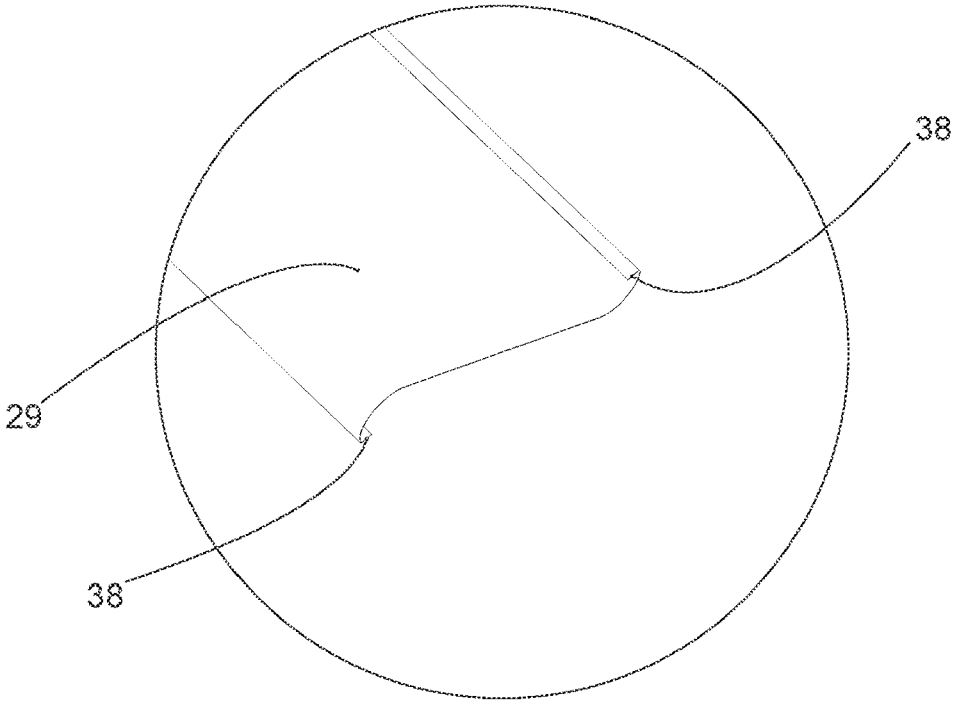
FIG. 36 shows an enlarged detail of the rotatable and compactable cover indicated as "M" in FIG. 35.

The relative pivoting movement between the assembly component 28 to which the movable side rail 23 is fixed, which is made possible by the axis 15 and the "C" shaped plate 26 that is joined to the folded plate 24 that is fixed in turn to the upper bar 7, allows a condition to be created according to which the movable side rails 23, as a whole, can maintain a condition of parallelism even during the movement of the movable supporting elements 4, as can be seen in the sequence depicted in FIGS. 22, 23 and 24 and according to the movement arrows "M1" (FIG. 23) and "M2" (FIG. 24).

The movable side rails 23 together form a structure that serves as a place for the assembly, also in a pivoting way, of the continuous cover plates 29 (which can be seen in FIGS. 1, 2, 4, 5, 7, 10, 11, 13, 16, 17, 18, 19, 20, 21, 22, 23, 24, 25, 26, 27, 29, 30, 31, 33, 34, 35, 36, 46, 47, 48, 49, 50, 51, 52, 53 and 54).

The continuous cover plates 29 are mounted on the movable side rails 23 by means of pivoting support elements 30 (which can be seen in FIGS. 4, 5, 10, 11, 16, 17, 25, 26, 27, 28, 29, 30, 31, 35 and 37), which are mounted spaced-apart along the movable side rails 23.

The pivoting support elements 30 are positioned along the continuous cover plates 29 in the crossing sections hereof with the movable side rails 23.

Figure 37:
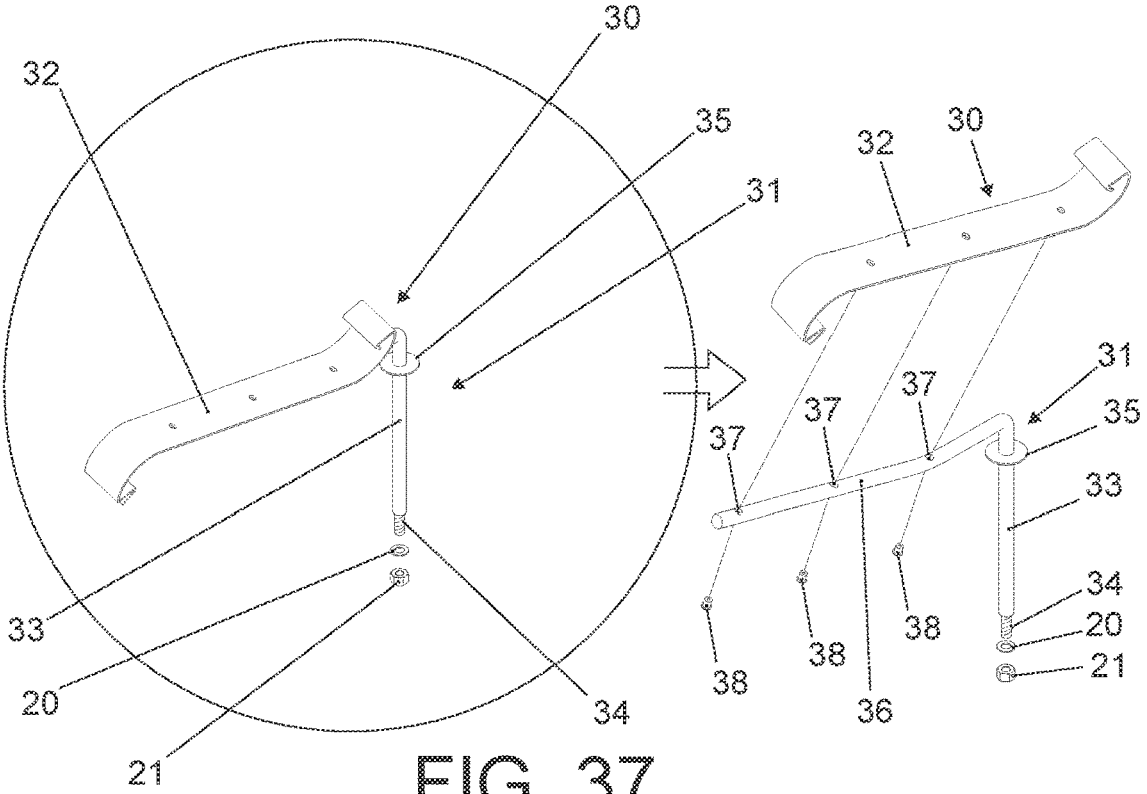
FIG. 37 shows an enlarged detail of the rotatable and compactable cover taken from FIG. 35, such as the one indicated as "N", said Figure includes a detail, in exploded perspective, of the pictured component.
Figure 38:
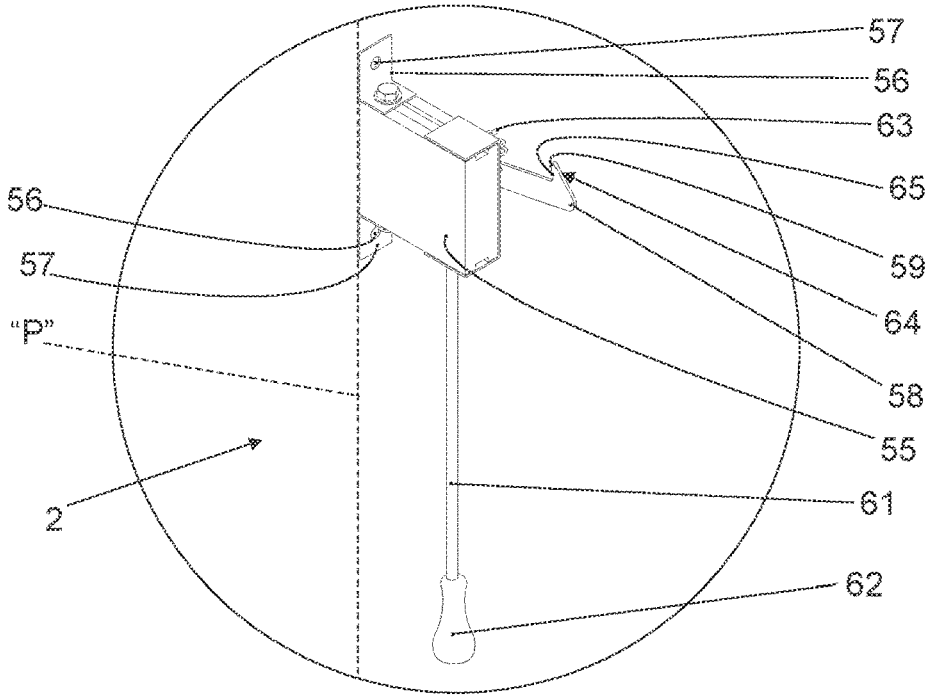
FIG. 38 shows an enlarged detail of the rotatable and compactable cover taken from FIG. 35, such as indicated as "O"
Figure 39:
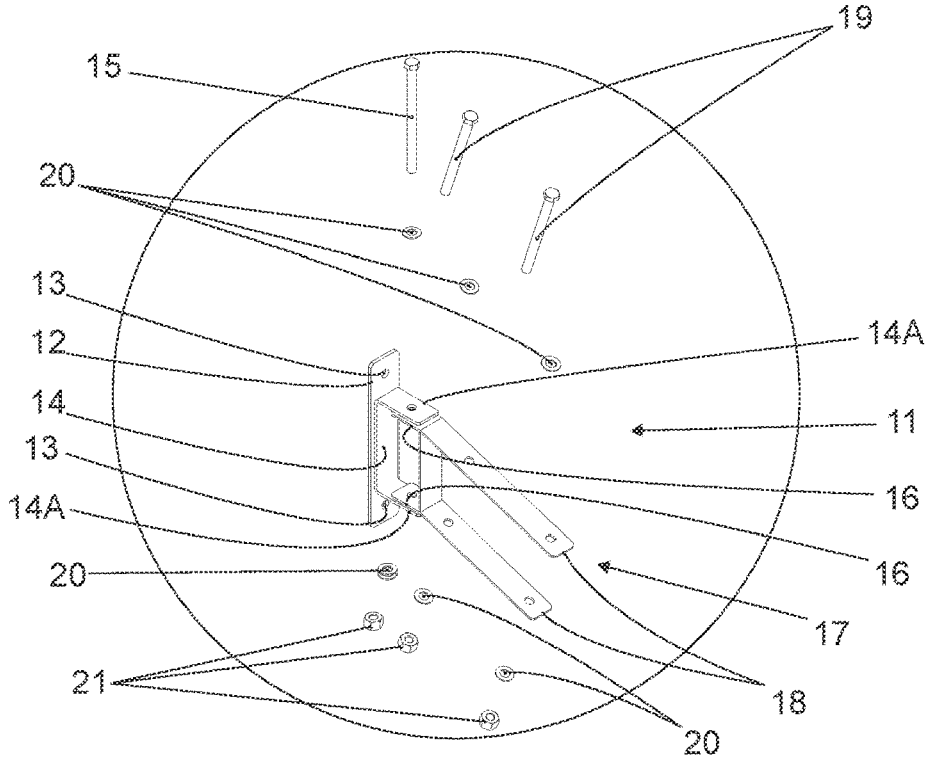
FIG. 39 shows an enlarged detail of the rotatable and compactable cover taken from FIG. 35, such as indicated as "P"
Figure 40:
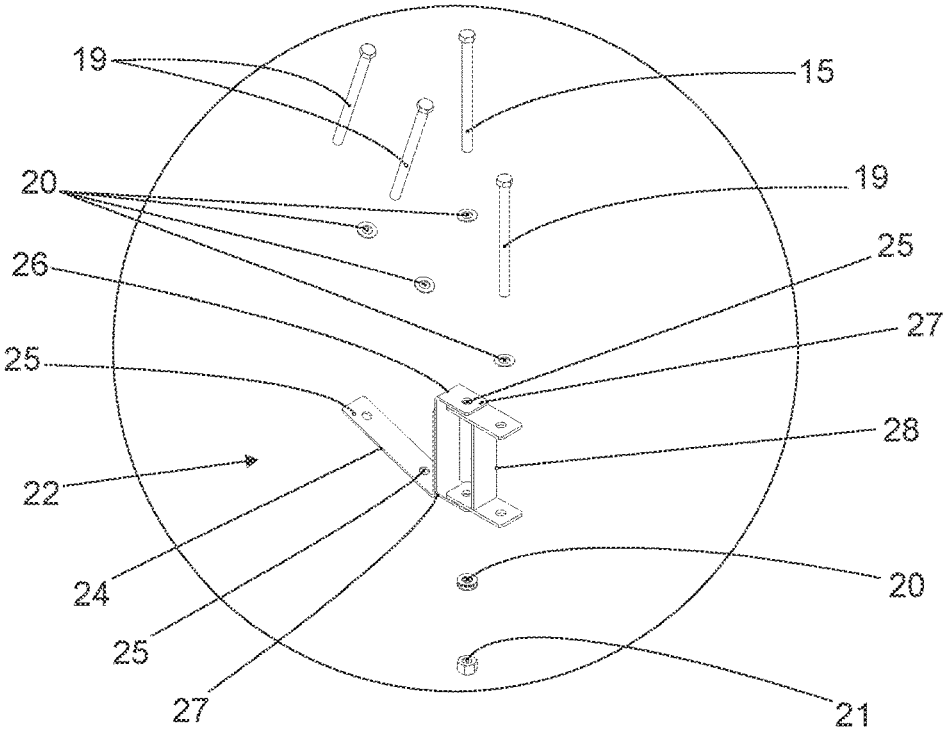
FIG. 40 shows an enlarged detail of the rotatable and compactable cover taken from FIG. 35, such as indicated as "Q"
Figure 41:
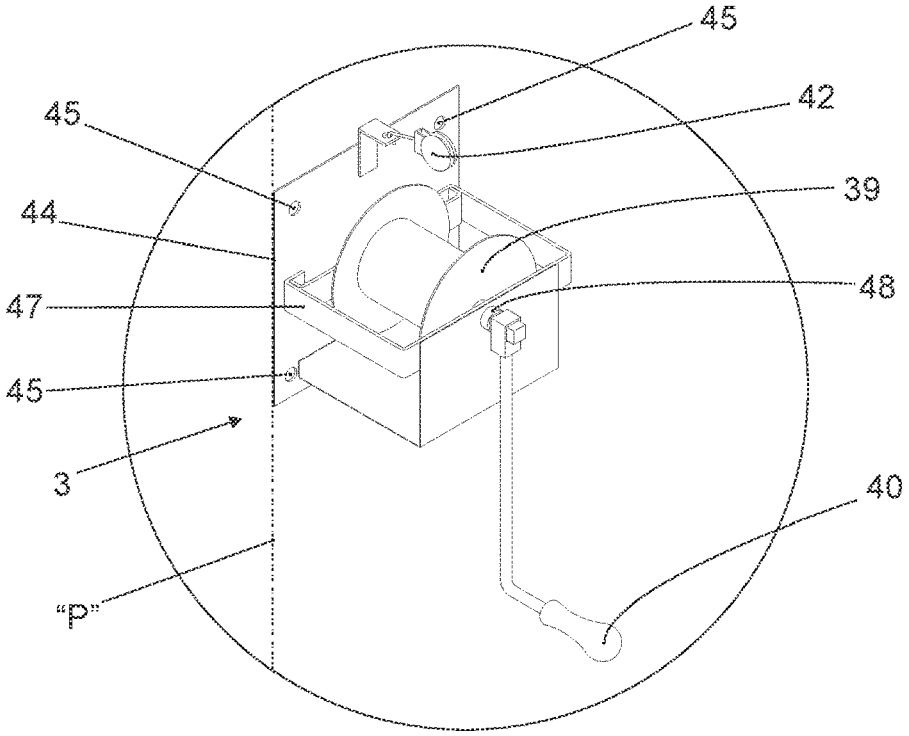
FIG. 41 shows an enlarged detail of the rotatable and compactable cover taken from FIG. 35, such as indicated as "R"
Figure 42:
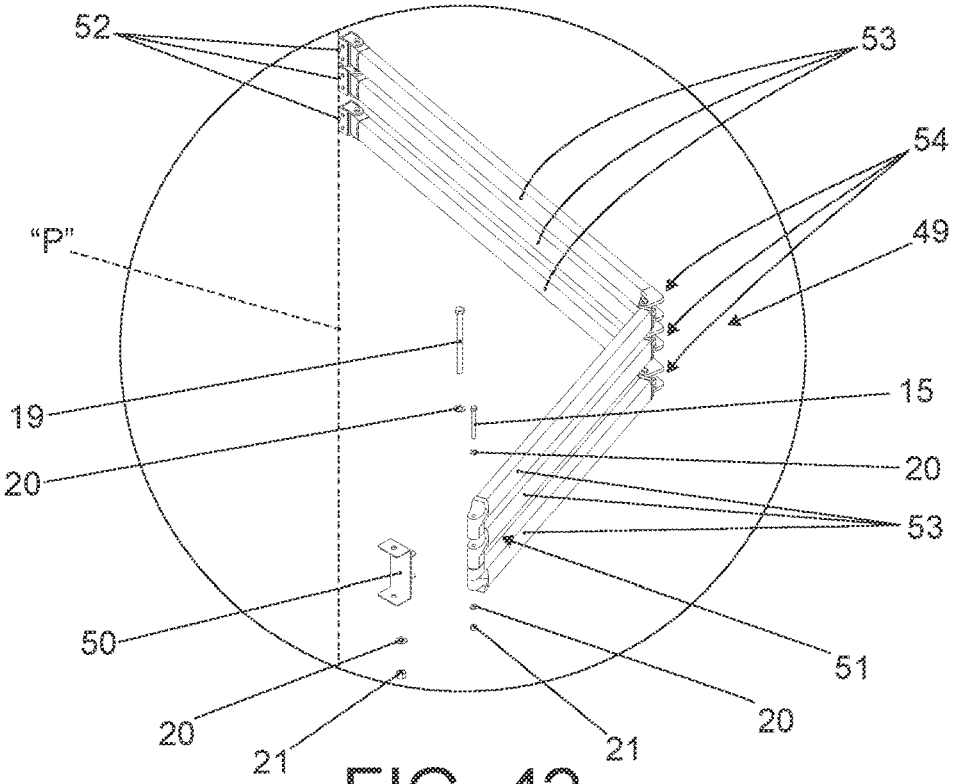
FIG. 42 shows an enlarged detail of the rotatable and compactable cover taken from FIG. 35, such as indicated as "S"
Figure 43:
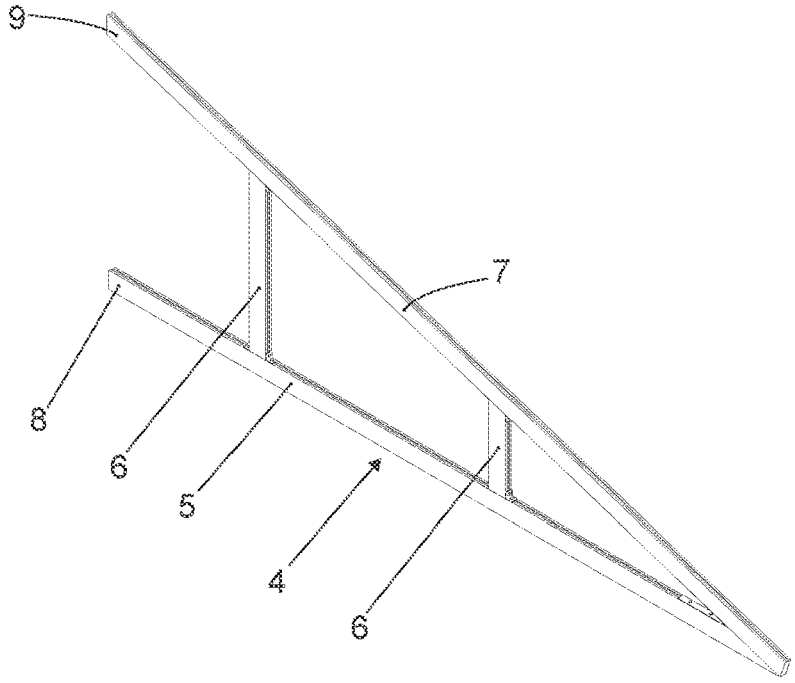
FIG. 43 shows an enlarged detail of the rotatable and compactable cover taken from FIG. 35, such as indicated as "T"
Figure 44:
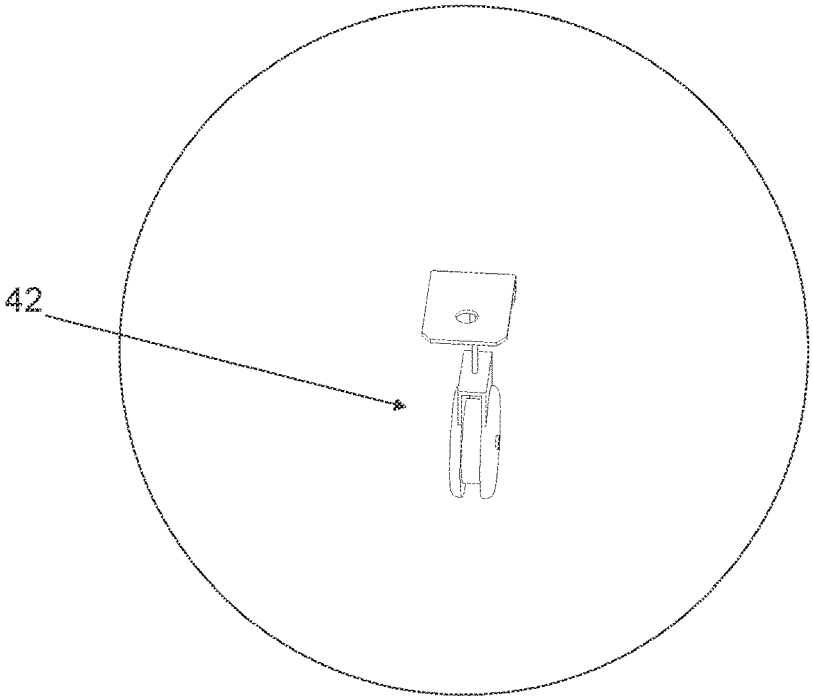
FIG. 44 shows an enlarged detail of the rotatable and compactable cover taken from FIG. 35, such as indicated as "U"
Figure 45:
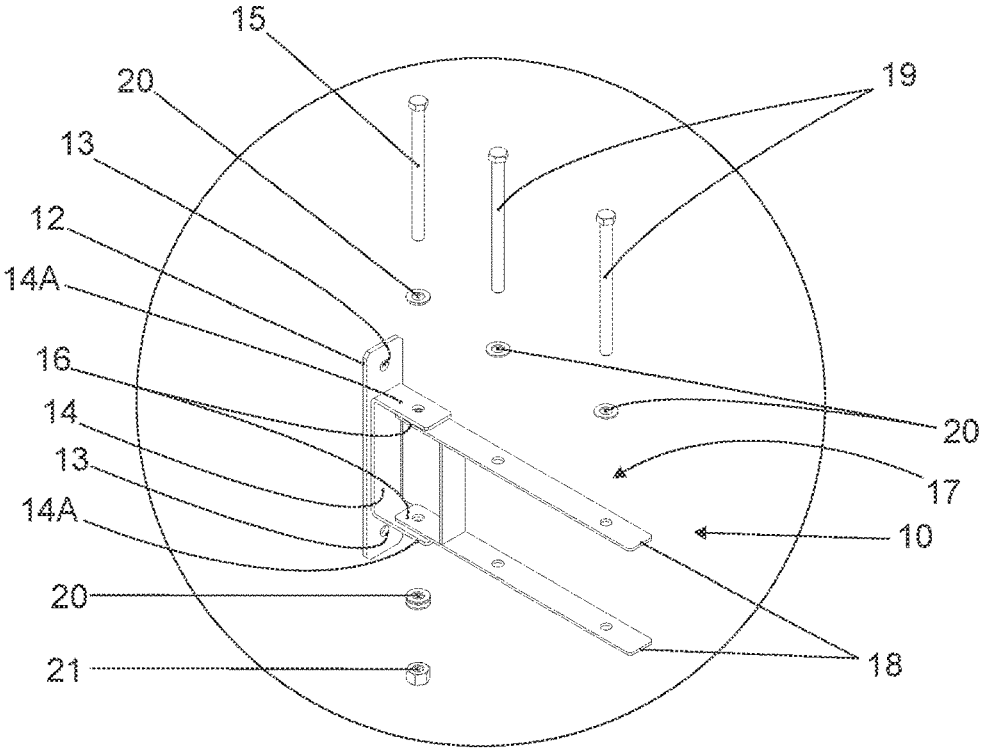
FIG. 45 shows an enlarged detail of the rotatable and compactable cover taken from FIG. 35, such as indicated as "V"
Figure 46:
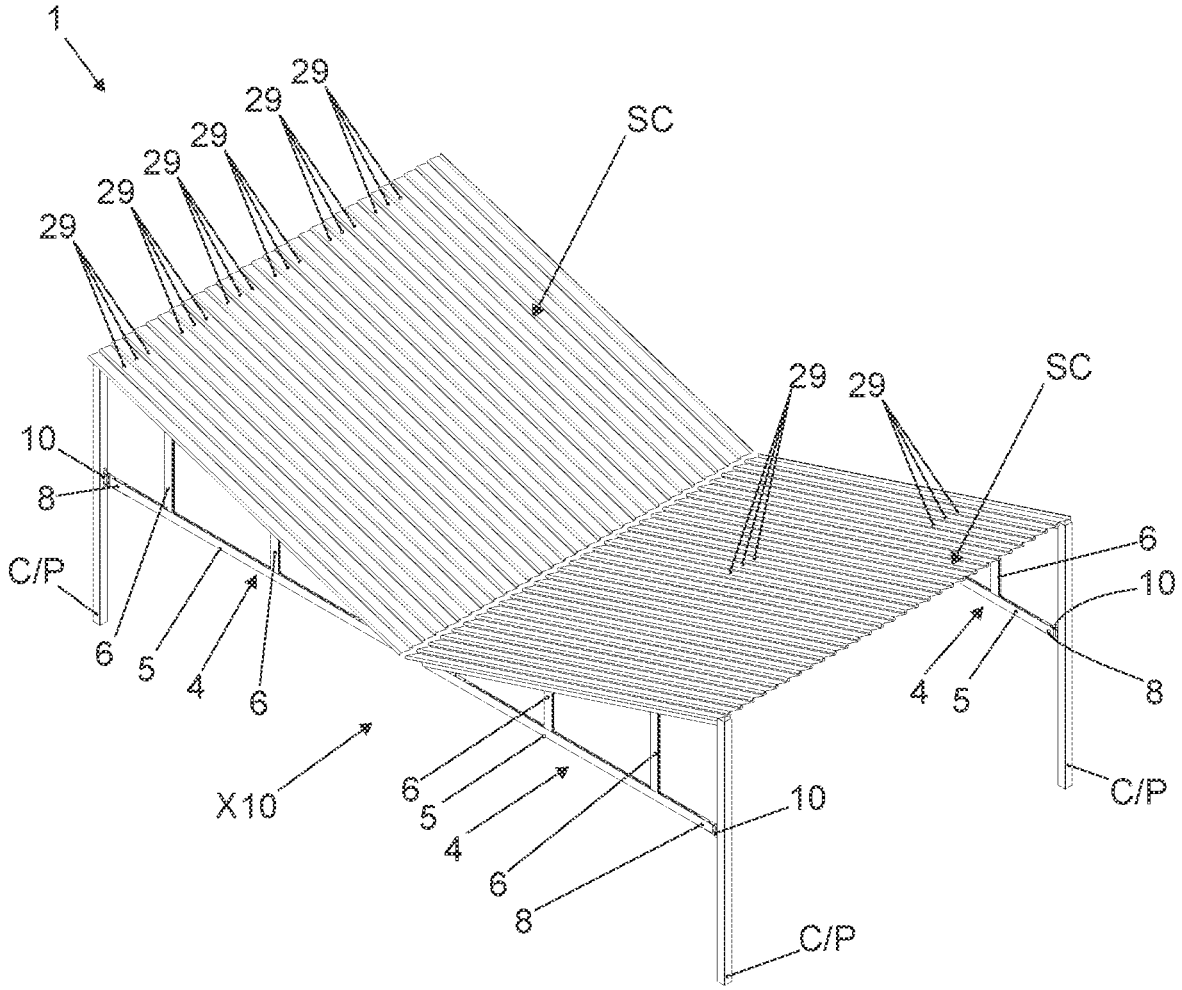
FIG. 46 shows a side perspective view of an alternative configuration of the rotatable and compactable cover, in which two units of said cover are used, one facing the other, so that the rainwater falls through the central region between them.
Figure 47:
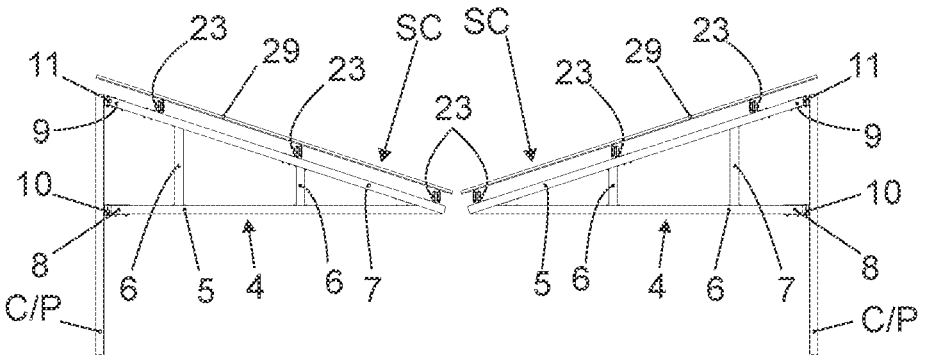
FIG. 47 shows a front view of the alternative configuration of the rotatable and compactable cover depicted in FIG. 46, said front view being taken as indicated by the arrow X10.

The pivoting support element 30 can be seen, in isolation, through the observation of FIG. 37, in which it can be seen that said pivoting support element 30 is basically formed by two components, the first one being the support 31, while the second component is a laminar piece 32 with a shape compatible with the cross section presented by the continuous cover plates 29.

The support rod 31 has a vertical rod section 33 inferiorly provided with a threaded end 34 that receives a washer 20 and a corresponding clamping nut 21, said vertical section 33, at its upper end, has a welded washer 35 that acts as an insert limiting element in relation to the profile of the side rail 23.

The vertical rod section 33 of the pivoting support element 30 continues in an angled rod section 36 that receives the laminar piece assembly 32, said angled rod section 36 is provided with through holes 37, where the aforementioned laminar piece assembly 32 is fixed by means of rivets 38 and against which the continuous cover plate 29 is effectively mounted.

When the rotatable and compactable cover 1 is in its "fully extended" condition (as shown in FIGS. 1, 7, 13, 18, 19, 20, 21, 22, 46, 47, 48, 49, 50, 51, 52, 53 and 54), the continuous cover plates 29 are parallel with respect to the inclined plane of the cover so that only their alternately up and down curved longitudinal edges 38 overlap (as can be seen in FIGS. 1, 7, 19, 20, 21, 22, 46, 48, 50 and 54).

When the rotatable and compactable cover 1 is in its "partially extended" condition (as can be seen in FIG. 23), the continuous cover plates 29 of the continuous cover plate 29 set are no longer parallel to the inclined plane of the cover, a fact that determines that its alternately up and down curved longitudinal edges 38 cease to overlap progressively, whereas being continued to move in the direction indicated by the arrows "M1" (FIG. 23) and "M2" (FIG. 24), such continuous cover plates 29 start to overlap more and more effectively.

When the rotatable and compactable cover 1 reaches its limit position (as can be seen in FIG. 24), it reaches its "fully folded and compacted" condition, which is also depicted in FIGS. 25, 29, 33 and 34.

When the rotatable and compactable cover 1 reaches its "fully folded and compacted" condition (as shown in FIG. 24), the set of continuous cover plates 29 assumes a position that defines a compact package PC, where said continuous cover plates 29 are superimposed, thus, maintaining in this new condition the parallelism that accompanies the slope angle of the upper bar 7.

Especially in relation to FIGS. 22, 23 and 24, the initial (FIG. 22), intermediate (FIG. 23) and final (FIG. 24) positioning are depicted, and in FIG. 22 the set of continuous cover plates 29 forms a cover surface SC (which can also be seen in FIGS. 1, 7, 13, 18, 19, 20, 21, 46, 47, 48, 49, 50, 51, 52, 53 and 54). The cover surface SC corresponds to the total coverage of the area under the rotatable and compactable cover 1.

When the rotatable and compactable cover 1 is in the condition shown in FIG. 24, that is, "fully folded and compacted", the set of continuous cover plates 29 takes on the condition of a package PC, which is also shown in FIGS. 24, 25, 26, 27, 29, 33 and 34.

The transition from the "fully extended" condition to the "fully folded and compacted" condition is done by operation, according to the embodiment shown in this patent application, using the retraction device 3, which includes a reel 39 driven by a crank 40 where the cable 41 is wound, and when leaving said reel 39, it passes through a guiding pulley 42.

Consideration should be given to the possibility that in a motorized version, the retraction device 3 can be equipped with an electric motor controlled either directly or by means of remote control. The aforementioned motorized version, although not shown, does not require further details to be perfectly understood.

The retraction device 3 incorporates a structure 43 where the reel 39 and the guiding pulley 42 are mounted, said structure 43 including a bottom plate 44 provided with through holes 45 for the passage of screws with which the retraction device 3 can be mounted on the wall or other suitable architectural structure.

From the front face of the bottom plate 44 start a folded plate 46, which defines the bottom and front faces of the reel 39 assembly structure, and a support base 47, in which the axis 48 of said reel 39 is traversed.

When the crank 40 is rotated counterclockwise, the cable 41 is wound on the reel 39, being guided along this path by the guiding pulley 42 incorporated in the retraction device 3.

Figure 21:
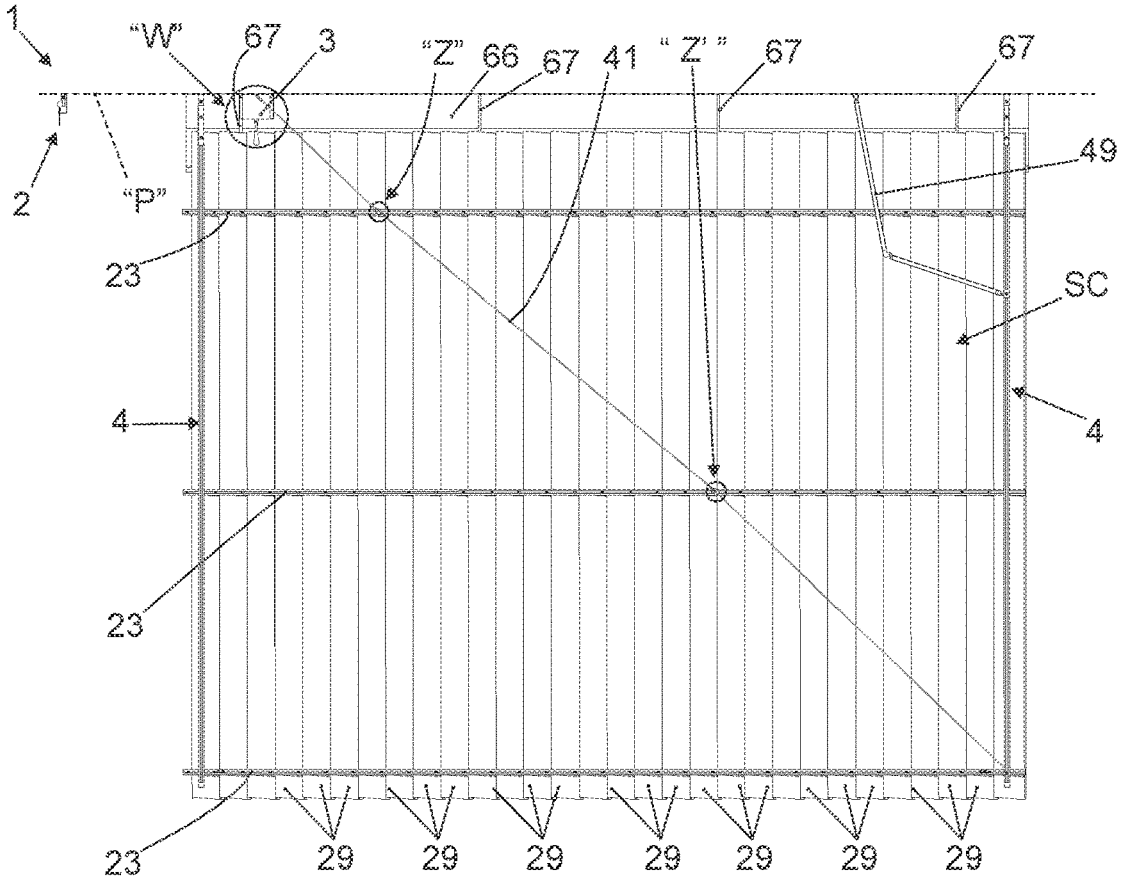
FIG. 21 shows a bottom view of the rotatable and compactable cover, the bottom view taken according to the arrow X5 indicated in FIGS. 1 and 7.
Figure 21A:
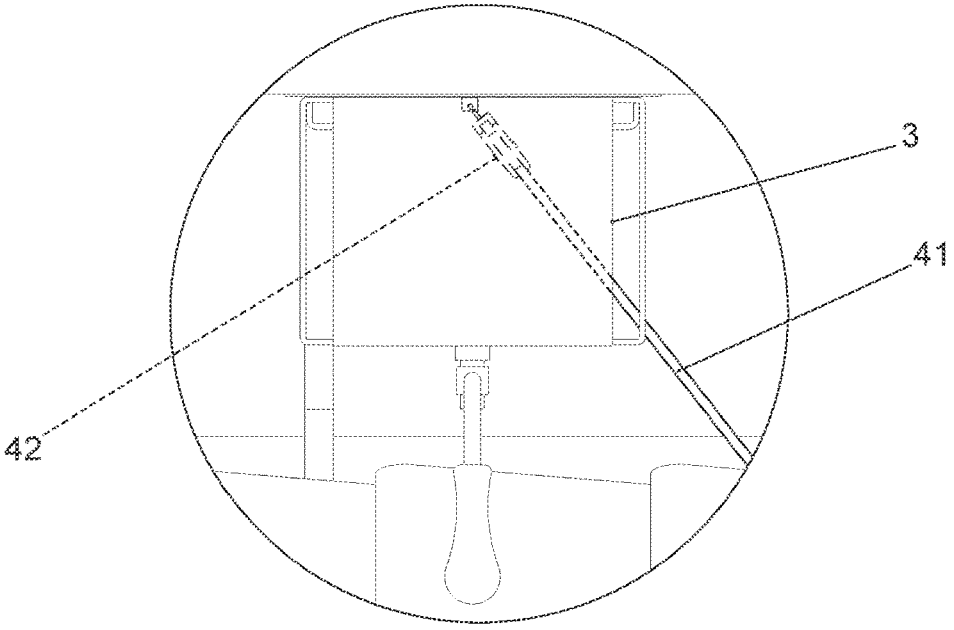
FIGS. 21A, 21B and 21C illustrate enlarged views taken from FIG. 21, which depict enlarged details taken from the "W", "Z" and "Z'" details, which depict the passage of the cable used to move the rotatable and compactable cover between its "fully extended" condition to its "fully folded and compacted" condition.
Figure 21B:
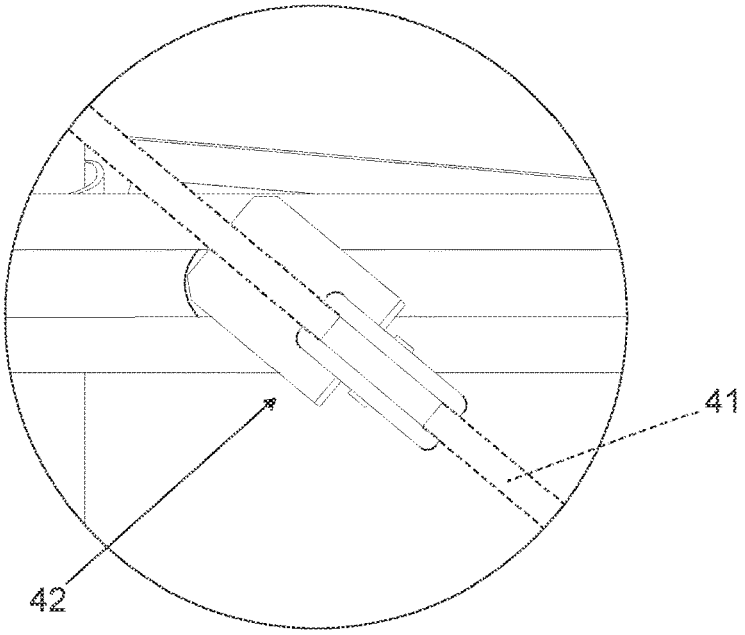
Figure 21C:
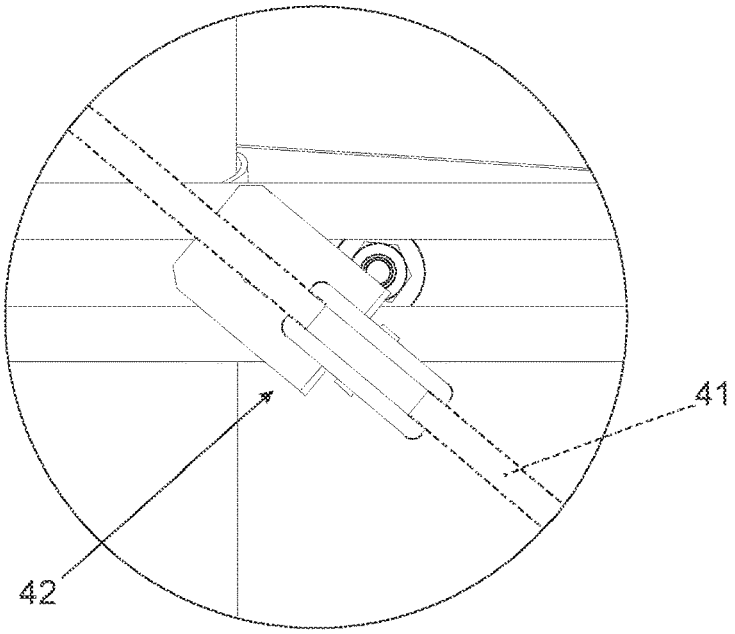

The cable 41 first passes through two other guiding pulleys 42 that are mounted on the underside of two of the movable side rails 23, as can be seen in FIG. 21 and in the enlarged details depicted in FIGS. 21A (detail "W"), 21B (detail "Z") and FIG. 21C (detail Z"). The cable 41 is then anchored to the movable supporting element 4.

The guiding pulleys 42 mounted on the movable side rails 23 and where the cable 41 passes can be seen in FIGS. 21B, 21C, 25, 26, 27, 29, 30, 31, 35 and 44.

The compaction movement of the rotatable and compactable cover 1 occurs against the effort of a set of actuators 49 (commercial model) comprised by arms with tension springs (which can be seen in FIGS. 7, 13, 18, 19, 20, 21, 24, 33, 34, 35 and 42).

The set of actuators 49 is mounted by one end against the face of the wall "P" or another suitable architectural structure (for example, columns/posts), said wall "P" having a plan that is schematically indicated through a dashed line in the FIGS. 1, 2, 3, 6, 12A, 13, 14, 15, 20, 21, 22, 23, 25, 26, 29, 30, 32, 34, 38, 41 and 42, while the opposite end of the set of actuators 49 is mounted at a suitable point on the lower bar 5, this second end being fitted with a "C" shaped terminal 50, which is traversed by a vertical axis 15 in the form of a screw, said vertical axis 15 being traversed concomitantly at terminal 51 of the set of actuators 49, such axis 15 being fixed using washers 20 and clamping nut 21.

The assembly of the "C" shaped terminal 50 is done in such a way that this component can present the possibility of angular movement in relation to the terminal 51.

In turn, the "C" shaped terminal 50 is fixed by a screw 19 and its washer 20 and clamping nut 21 against the lower bar 5, not having, contrary to what was verified with the "C" shaped terminal 50, possibility of angular movement with respect to the lower bar 5.

The opposite ends of the actuators 49 comprise fastening components 52 that are mounted against the wall "P" and that allow angular movement of the arm connected to it.

Each actuator 49 comprises two arm segments 53 joined by a joint point 54, such structure being folded in the closing direction or unfolded in the opening direction as the rotatable and compactable cover 1 is fully extended or folded and compressed.

The maintenance of the rotatable and compactable cover 1 in its "fully folded and compacted" condition and against the action of the actuators 49 is guaranteed by the locking device 2 defined as a base 55 with fixing tabs 56, each having a hole 57 for passing screws with which the locking device 2 can be fixed to the wall "P".

The locking device 2 has a flat blade 58 provided with a retaining upward facing tooth 59, the flat blade 58 being pivoted on an axis 60 positioned on the side of the base 55. The flat blade 58 has an operating lever 61 provided with a knob 62, which is used to unlock the rotatable and compactable cover 1 when it is in the "fully folded and compacted" condition.

The flat blade 58 is held up by the action of a coil spring 63 and has a ramp profile 64, which defines the aforementioned retaining tooth 59 with an opposite vertical edge 65.

The operating principle of the locking device 2 is directly related to the operation of the retraction device 3, since the locking device 2 acts on the retention of the lower bar 5 of the movable element 4 at the end of the compacting course of the angularly reversible and packable structure 1.

The aforementioned locking occurs when the lower bar 5 of the movable supporting element 4, already in the final section of its displacement, touches the ramp profile 64, thus causing the flat blade 58 to be slightly lowered, rotating on the axis 60 against the action of the coil spring 63 enough that the end of the retaining upward facing tooth 59 is overtaken by the bottom face of said lower bar 5.

Upon reaching this stage, the coil spring 63 pulls up the flat blade 58, turning it on the axis 60 so that the corresponding portion of the face of the lower bar 5 contacts the opposite vertical edge 65.

When the above stage is reached, the retractable device 3 can be relieved, since the structure of the rotatable and compactable cover 1 will already be prevented from returning to its "fully extended" condition, since it will be retained by the locking device 2.

The return of the rotatable and compactable cover 1 to its "fully extended" condition simply requires the operation of the locking device 2 so that its operating lever 61 is pushed towards the wall enough to allow the lower bar 5 to be released from the retaining upward facing tooth 59, and when occurring, actuators 49 will force the angular displacement of the entire structure until the movable supporting elements 4 reach a position perpendicular to the plane of the wall "P".

The upper region of the rotatable and compactable cover 1 incorporates a pair of blades 66 arranged at an angle compatible with the angle of the cover surface SC, said blades 66 being mounted on supports 67 fixed directly to the wall "P" and cover the upper end of the continuous cover plates 29.

Optionally, the rotatable and compactable cover 1 can be used in a composition of two units, as shown in FIGS. 46, 47, 48, 49, 50, 51, and 54, where the wall "P" as an assembly location can be replaced by adopting columns or posts C/P.

Figure 48:
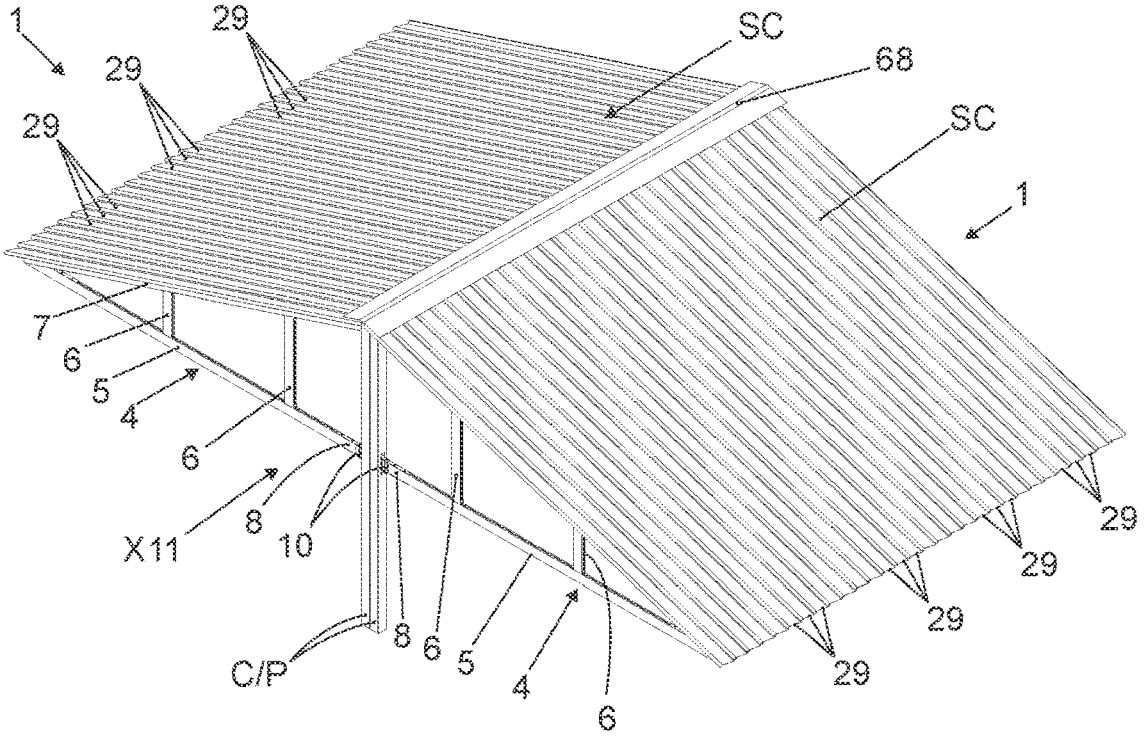
FIG. 48 shows a side perspective view of another alternative configuration of the rotatable and compactable cover, in which two units of said cover are used, one facing the other so that the rainwater falls through the extreme region of each one of them.
Figure 49:
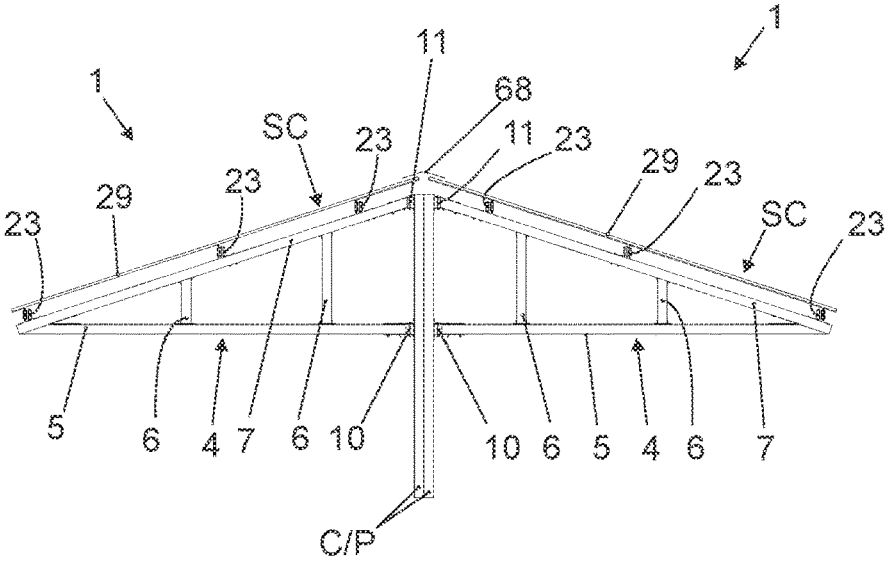
FIG. 49 shows a front view of the alternative configuration of the rotatable and compactable cover shown in FIG. 18, said front view being taken as indicated by the arrow X11.
Figure 50:
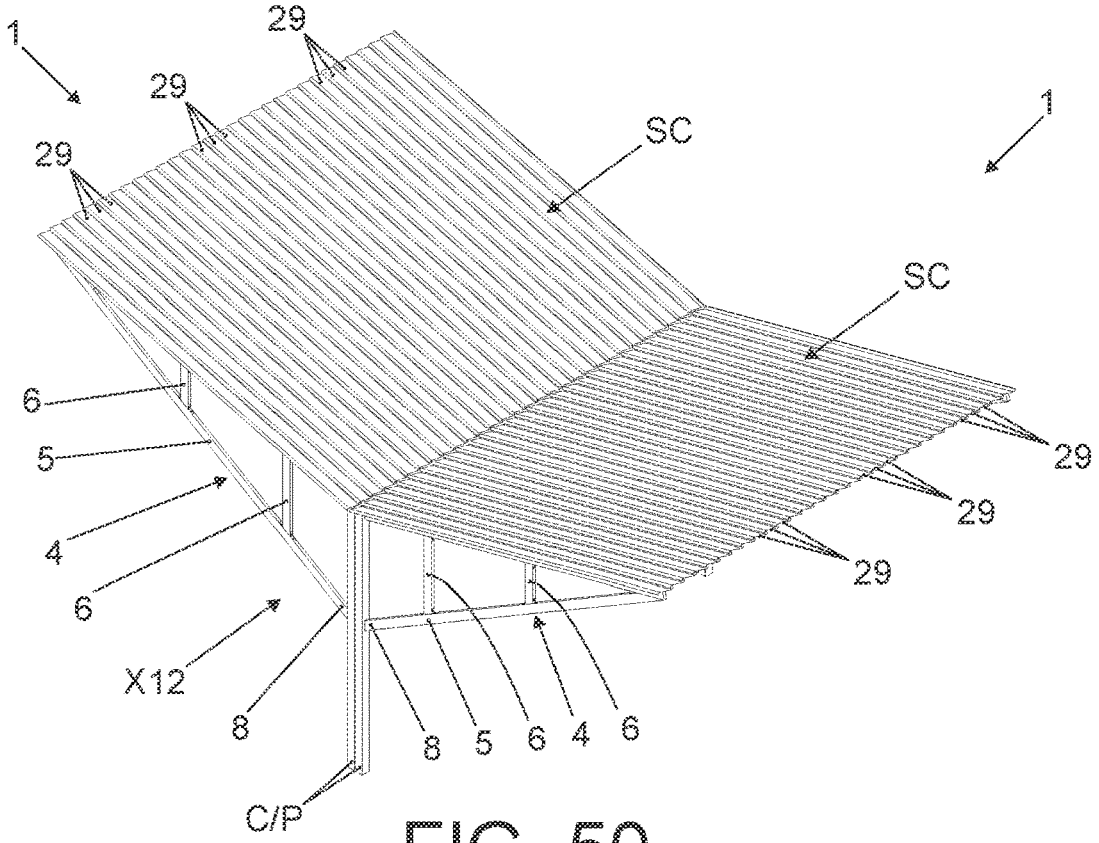
FIG. 50 shows a side perspective view of yet another alternative configuration of the rotatable and compactable cover, in which two units of said cover are used, one facing the other and in an inverted angle in relation to that presented in the version depicted in FIG. 49, so that the rainwater falls through the central region between both.
Figure 51:
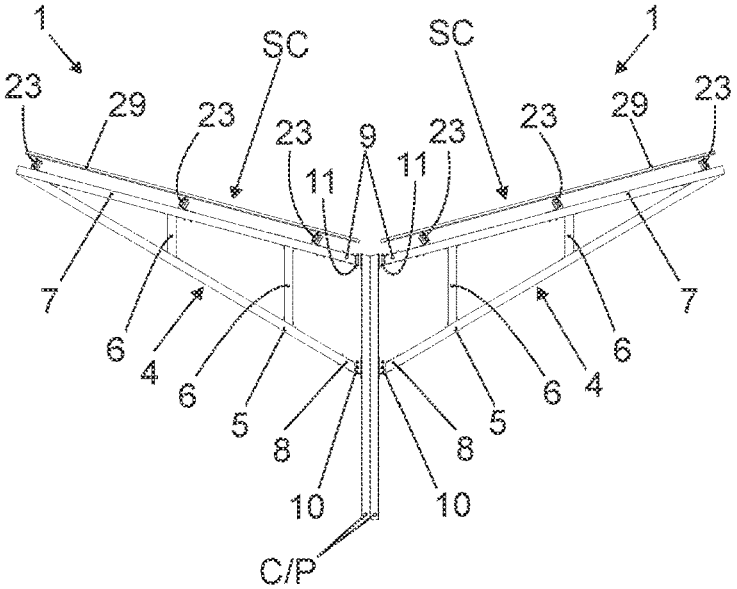
FIG. 51 shows a front view of the alternative configuration of the rotatable and compactable cover shown in FIG. 50, said front view being taken as indicated by the arrow X12.
Figure 53:
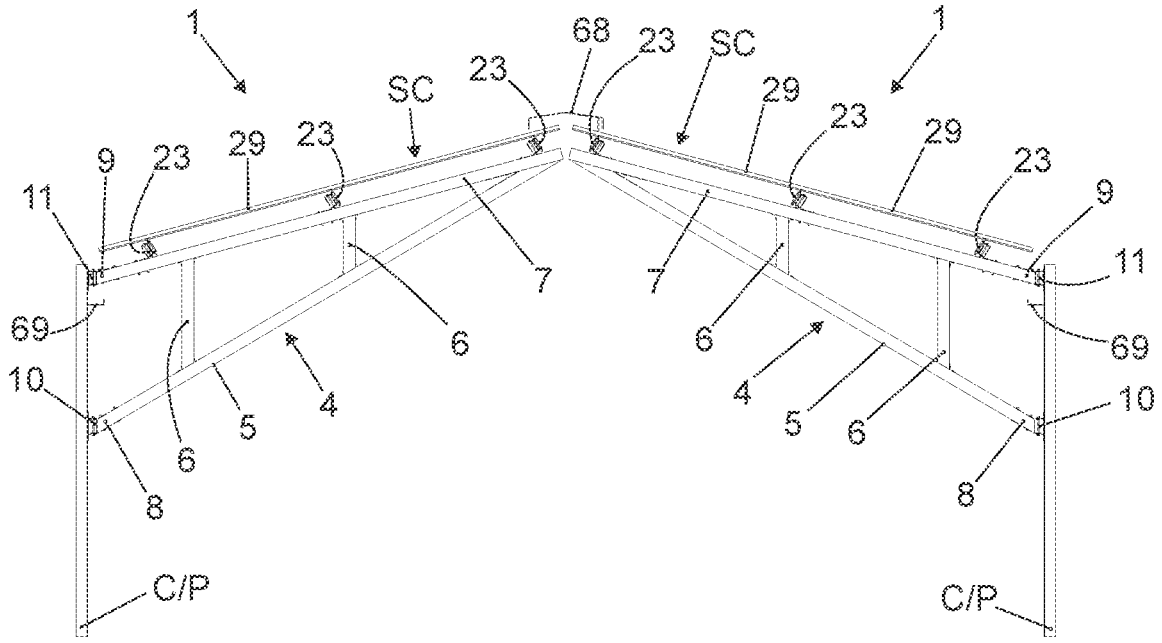
FIG. 53 shows a side view of yet another alternative configuration of the rotatable and compactable cover, such alternative uses two copies of the alternative configuration depicted in FIG. 22, where said cover units face each other.

When necessary, the assembly of two units of the rotatable and compactable cover 1 can incorporate a casing 68 that covers the upper end of the continuous cover plates 29 preventing the entry of rainwater, said casing 68 incorporated in only one of the two units of the rotatable and compactable cover 1, as shown in FIG. 48, 49 or 53.

Figure 52:
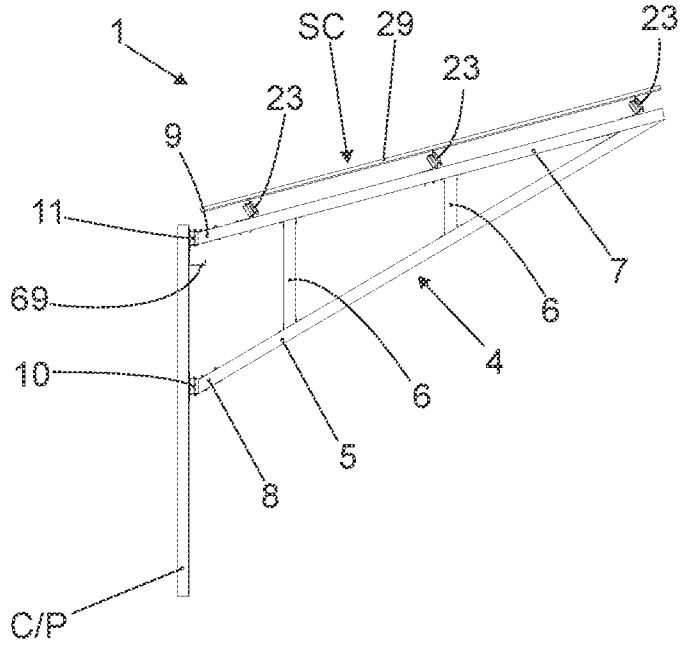
FIG. 52 shows a side view of yet another alternative configuration of the rotatable and compactable cover, where only one unit of said cover is used, with its inclined plane inverted.

Depending on the assembly configuration, the angularly foldable and compactable structures 1 can also have gutters 69, as schematically shown in the FIGS. 52 and 53.

Figure 54:
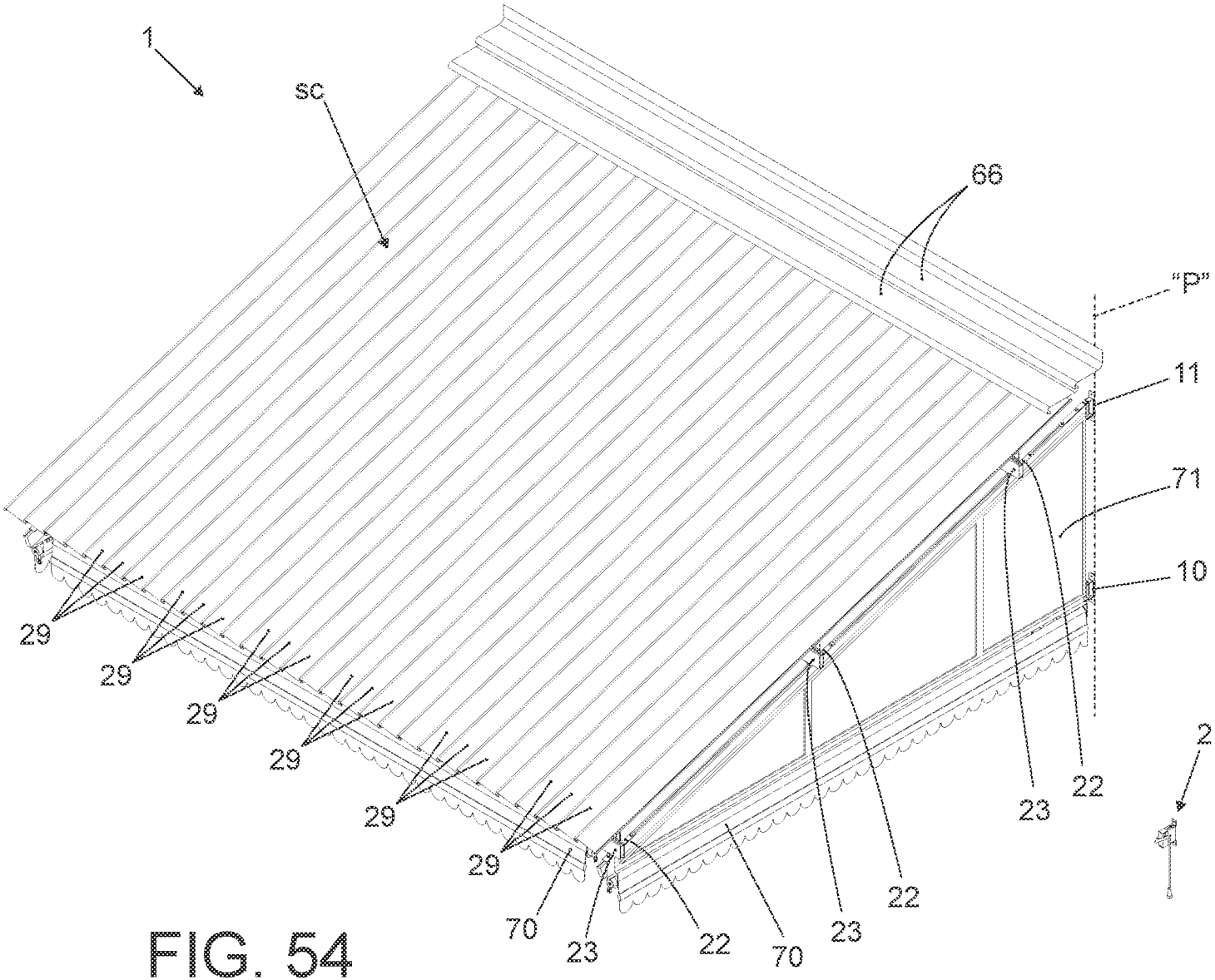
FIG. 54 illustrates a perspective view of the rotatable and compactable cover, which has two optional items, namely the cover fixed to the movable supporting elements and the roll-up plastic curtains mounted on the lower bar of each lower bar and on the movable side rail of the cover structure.

The rotatable and compactable cover 1 can optionally incorporate an accessory consisting of roll-up curtains 70, as shown in FIG. 54, said view also including a cover plate 71, said accessory fixed on the outer faces of the movable supporting elements 4, thus allowing the covered area to be protected at an even higher level. Although said FIG. 54 depicts only a cover plate 71, it should be understood that the two sides of the rotatable and compactable cover 1 will receive said accessory 71.

The invention claimed is:

1. A rotatable and compactable cover comprising:

continuous cover plates that define a cover surface the cover surface being an inclined plane, the cover being mounted to one of a wall, a column, and a post, wherein the cover plates include metal profiles;

two movable elements mounted directly against and rotatable with one of the wall, the column, and the post;

movable side rails, mounted on and rotatable with the two movable elements, which are mutually parallel;

pivoting support elements, privotably mounted on the movable side rails, against which the continuous cover plates are attached;

actuators comprised of arms with tension springs;

a locking device and a retraction device, which are mounted on a same plane as the wall; and an upper region of the rotatable and compactable cover incorporates a pair of blades, said blades being mounted on supports fixed directly to the wall and covering an upper end of the continuous cover plates.

2. The rotatable and compactable cover according to claim 1, wherein the movable elements incorporate, at ends of lower and upper bars, joint terminals, the joint terminals having a vertical plate provided with holes, with horizontal flaps of a "C" shaped plate starting from a front face of the vertical plate that are traversed by a vertical axis in the a form of a screw that also traverses ends of protruding flaps of an assembly structure that is traversed on its long flaps by screws that also traverse ends of the lower and upper bars;

wherein the vertical axis and the screws have washers and nuts;

wherein the vertical axis constitutes a point around which the joint terminals the lower and upper bars that form the movable supporting elements rotate; and wherein in one of the joint terminals the long flaps are aligned with the protruding flaps, since the lower bar is horizontal, whereas in another of the joint terminals the protruding flaps form an angle with the long flaps correspondingly facing a top one of the lower and upper bars.

3. The rotatable and compactable cover, according to claim 2, wherein each movable supporting element is formed by assembly of the lower bar made with a metallic profile with a rectangular cross section from which two vertical bars with different heights and being made with a same profile extend vertically upwards, which are connected to the upper bar, the upper bar being also made based on the same profile as previous components.

4. The rotatable and compactable cover, according to claim 2, wherein:

on an upper face of the upper bar, joint supports are mounted on which, in turn, side rails are mounted; each joint support is formed by a folded plate with holes that is joined to a "C" shaped plate from which horizontal flaps 27) extend, also provided with holes, said "C" shaped plate being traversed by a vertical axis in a form of a screw, which also passes through an assembly component that receives an assembly of the movable side rail; and the mounting of the joint support to the upper bar is done by means of screws, also a screw and its respective washers and nuts being used to fix the assembly component to the movable side rails.

5. The rotatable and compactable cover, according to claim 1, wherein:

the movable side rails together form a structure that serves as a place for the an assembly, also pivotally, of the continuous cover plates;

the continuous cover plates are mounted on the movable side rails by the pivoting support elements, which are mounted spaced-apart along the movable side rails; the pivoting support elements are positioned along the continuous cover plates in crossing sections hereof with the movable side rails;

each of the pivoting support elements are is formed by two components, a first one being a support rod, while a second component being a laminar piece with a shape compatible with a cross section presented by the continuous plates cover;

the support rod has a vertical rod section being inferiorly provided with a threaded end that receives a washer and a corresponding clamping nut, said vertical section, at its upper end, featuring a welded washer that acts as a limiting element for its insertion in relation to a profile of the movable side rails; and the vertical rod section of the pivoting support element continues in an angled rod section that receives the laminar piece, said angled rod section provided with through holes, where the laminar piece is fastened by means of rivets and against which the continuous cover plate is effectively mounted.

6. The rotatable and compactable cover, according to claim 1, wherein:

the rotatable and compactable cover has a partially extended condition, a partially extended condition and a fully folded and compacted condition, and when in the partially extended condition, the continuous cover plates are parallel to the inclined plane of the rotatable and compactable cover with alternately up and down curved longitudinal edges overlapping;

when the rotatable and compactable cover is in the partially extended condition, the continuous cover plates are not to the inclined plane of the cover, and the curved longitudinal edges progressively stop overlapping; and when the rotatable and compactable cover reaches a limit position and is in the fully folded and compacted condition, the continuous cover plates defines a compact package, where said continuous cover plates follow a slope angle of the upper bar.

7. The rotatable and compactable cover according to claim 1, wherein:

the retraction device includes a reel driven by a crank where a cable is wound, said reel passing through a guiding pulley;

the retraction device also incorporates a structure where the reel and the guiding pulley are mounted, said structure including a bottom plate provided with through holes for passing screws with which the retraction device can be mounted on the wall;

a front face of the bottom plate has a folded plate, which defines bottom and front faces of the reel, and a support base, in which the axis of said reel is traversed;

when the crank is turned, the cable is wound on the reel, being guided in this path by the guiding pulley incorporated in the retraction device; and the cable first passes through two other guiding pulleys that are mounted on an underside of two of the movable side rails, an end of the cable being anchored in the movable element.

8. The rotatable and compactable cover, according to claim 1, wherein:

a compaction movement of the rotatable and compactable cover occurs against effort of the actuators;

the actuators are mounted, at one end, against a face of the wall, while an opposite end of the actuators is mounted on a lower bar of the movable supporting element, the opposite end receiving an assembly of a "C" shaped terminal, which is traversed by a vertical axis in a form of a screw, said vertical axis being traversed concomitantly in a terminal of the actuators, such axis being fixed using washers and clamping nuts; and the ends of the actuators against the wall have fastening components that are mounted against the wall and allow angular movement of arms connected to it.

9. The rotatable and compactable cover according to claim 1, wherein:

the locking device is defined as a base provided with fixing flaps, each having a hole for passing screws with which the locking device can be fixed to the wall;

the locking device has a flat blade provided with a retaining upward facing tooth, said flat blade being pivoted on an axis positioned on a side of the base;

the flat blade has an operating lever provided with a knob; and the flat blade is held up by action of a coil spring and has a ramp profile defining the retaining upward facing tooth, which has an opposite vertical edge.

10. The rotatable and compactable cover according to claim 1, wherein the rotatable and compactable cover incorporates, as accessories, roll-up curtains 70) and end plates; and wherein the cover plates are fixed on external faces of the movable supporting elements.

* * * * *